US005710822A

United States Patent [19]

Steenhagen et al.

[11] Patent Number: 5,710,822

[45] Date of Patent: Jan. 20, 1998

[54] FREQUENCY SELECTIVE ACTIVE ADAPTIVE CONTROL SYSTEM

[75] Inventors: Shawn K. Steenhagen, Madison, Wis.; Steve C. Southward, Cary, N.C.; Kent F. Delfosse, Madison, Wis.

[73] Assignees: Digisonix, Inc., Middleton, Wis.; Lord Corporation, Erie, Pa.

[21] Appl. No.: 553,186

[22] Filed: Nov. 7, 1995

[51] Int. Cl.[6] ..... G10K 11/16

[52] U.S. Cl. ..... 381/71.12

[58] Field of Search ..... 381/71, 94

[56] References Cited

U.S. PATENT DOCUMENTS

| | | |
|---|---|---|
| 4,677,676 | 6/1987 | Eriksson . |
| 4,677,677 | 6/1987 | Eriksson . |
| 4,736,431 | 4/1988 | Allie et al. . |
| 4,837,834 | 6/1989 | Allie . |
| 4,987,598 | 1/1991 | Eriksson . |
| 5,033,082 | 7/1991 | Eriksson et al. . |
| 5,146,505 | 9/1992 | Pfaff et al. . |
| 5,172,416 | 12/1992 | Allie et al. . |
| 5,206,911 | 4/1993 | Eriksson et al. . |
| 5,216,692 | 6/1993 | Ling . |
| 5,216,721 | 6/1993 | Melton . |
| 5,216,722 | 6/1993 | Popovich . |
| 5,278,780 | 1/1994 | Eguchi . |
| 5,278,913 | 1/1994 | Delfosse et al. . |
| 5,337,366 | 8/1994 | Eguchi et al. . |
| 5,386,472 | 1/1995 | Pfaff et al. . |
| 5,386,477 | 1/1995 | Popovich et al. . |
| 5,390,255 | 2/1995 | Popovich . |
| 5,396,561 | 3/1995 | Popovich et al. . |
| 5,586,190 | 12/1996 | Trantow et al. ..... 391/94 |

OTHER PUBLICATIONS

"Variable Structure Systems With Sliding Modes", V.I. Utkin, IEEE Transactions on Automatic Control, vol. AC-22, No. 2, Apr., 1977, pp. 212–222.

"Active Adaptive Sound Control In.A Duct: A Computer Simulation", J.C. Burgess, Journal of Acoustic Society of America, 70(3), Sep., 1981, pp. 715–726.

"Number Theory In Science And Communications", M.R. Schroeder, Berlin, Springer-Berlag, 1984, pp. 252–261.

*Adaptive Signal Processing*, Widrow and Stearns, Prentice-Hall, Inc., Engelwood Cliffs, NJ, 1985, pp. 376–378.

*Primary Examiner*—Forester W. Isen

*Attorney, Agent, or Firm*—Andrus, Sceales, Starke & Sawall

[57] ABSTRACT

An active adaptive control system and method has frequency dependent filtering with a transfer characteristic which is a function of a frequency dependent shaped power limitation characteristic maximizing usage of available output transducer authority. Band separation is provided for different tones. Power limit partitioning is provided for effectively distributing power between correction tones to maximize model performance.

72 Claims, 13 Drawing Sheets

FREQUENCY SELECTIVE ACTIVE ADAPTIVE CONTROL SYSTEM

BACKGROUND AND SUMMARY

The invention relates to active adaptive control systems, and more particularly to improvements for frequency dependency, including tonal systems.

The invention arose during continuing development efforts relating to the subject matter of U.S. Pat. Nos. 4,837,834, 5,172,416, 5,278,913, 5,386,477, 5,390,255, and 5,396,561, incorporated herein by reference.

Active acoustic attenuation involves injecting a canceling acoustic wave to destructively interfere with and cancel an input acoustic wave. In an active acoustic attenuation system, the output acoustic wave is sensed with an error transducer, such as a microphone or an accelerometer, which supplies an error signal to an adaptive filter control model which in turn supplies a correction signal to a canceling output transducer, such as a loudspeaker, shaker, or other actuator, including components such as D/A converters, signal conditioners, power amplifiers, which injects an acoustic wave to destructively interfere with the input acoustic wave and cancel or reduce same such that the output acoustic wave at the error transducer is zero or some other desired value.

An active adaptive control system minimizes an error signal by introducing a control signal from an output transducer to combine with the system input signal and yield a system output signal. The system output signal is sensed with an error transducer providing the error signal. An adaptive filter model has a model input from a reference signal correlated with the system input signal, an error input from the error signal, and outputs a correction signal to the output transducer to introduce a control signal matching the system input signal, to minimize the error signal. The filter coefficients are updated according to a weight update signal which is the product of the reference signal and the error signal.

The present invention is applicable to active adaptive control systems, including active acoustic attenuation systems. The invention maximizes model performance and protects the output transducer or actuator against overdriving of same. The invention enables appropriate sizing of output transducers, which is particularly cost effective in vibration applications by eliminating the need to oversize such transducers or actuators. For example, a resonant actuator can be damaged if overdriven at a resonant frequency. Prior solutions include oversizing of the actuators, which is not desirable from a cost standpoint.

DETAILED DESCRIPTION

Figure 1:
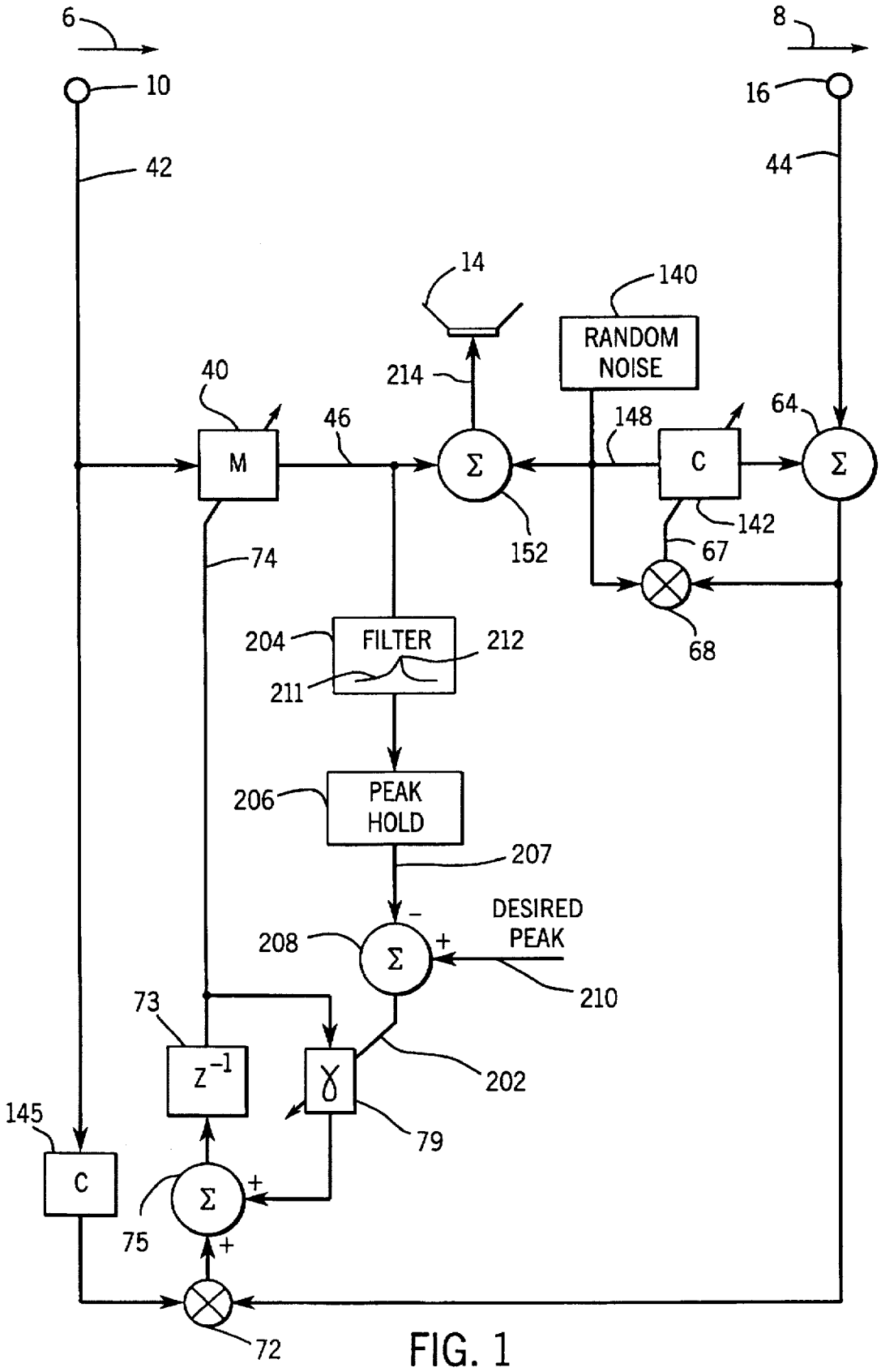
FIG. 1 is a schematic illustration of an active adaptive control system and method in accordance with the invention.

FIG. 1 shows an active adaptive control system similar to that shown in U.S. Pat. No. 4,677,676, incorporated herein by reference, and uses like reference numerals therefrom where appropriate to facilitate understanding. The system introduces a control signal from a secondary source or output transducer 14, such as a loudspeaker, shaker, or other actuator or controller, to combine with the system input signal 6 and yield a system output signal 8. An input transducer 10, such as a microphone, accelerometer, tachometer, or other sensor, senses the system input signal and provides a reference signal 42. An error transducer 16, such as a microphone, accelerometer, or other sensor, senses the system output signal and provides an error signal 44. Adaptive filter model 40 adaptively models the system and has a model input from reference signal 42 correlated to system input signal 6, and an output outputting a correction signal 46 to output transducer 14 to introduce the control signal according to a weight update signal 74. Reference signal 42 and error signal 44 are combined at multiplier 72 to provide the weight update signal through delay element 73. In a known alternative, the reference signal 42 may be provided by one or more error signals, in the case a periodic system input signal, "Active Adaptive Sound Control In A Duct: A Computer Simulation" J. C. Burgess, Journal of Acoustic Society of America, 70(3), September 1981, pages 715–726, U.S. Pat. Nos. 5,206,911, 5,216,722, incorporated herein by reference.

Auxiliary signal source 140 introduces an auxiliary signal into the output of model 40 at summer 152 and into the C model at 148. In one form, the auxiliary signal is a random signal uncorrelated with the system input signal 6 and in preferred form is provided by a Galois sequence, M. R. Schroeder, "Number Theory In Science And Communications", Berlin, Springer-Berlag, 1984, pages 252–261, though other random uncorrelated signal sources may be used. The Galois sequence is a pseudo random sequence that repeats after $2^M$-1 points, where M is the number of stages in a shift register. The Galois sequence is preferred because it is easy to calculate and can easily have a period much longer than the response time of the system. The input 148 to C model 142 is multiplied with the error signal from error transducer 16 at multiplier 68, and the resultant product provided as weight update signal 67. Model 142 models the transfer function of the error path from output transducer 14 to error transducer 16, including the transfer function of each. Alternatively, the transfer function from output transducer 14 to error transducer 16 may be modeled without signal source 140, as in U.S. Pat.

No. 4,987,598, incorporated herein by reference. Auxiliary source 140 introduces an auxiliary signal such that error transducer 16 also senses the auxiliary signal from the auxiliary source. A copy of model 142 is provided at 145 to compensate the noted transfer function, as in the incorporated '676 patent.

In updating the filter coefficients, and as is standard, one or more previous weights are added to the current product of reference signal 42 and error signal 44 at summer 75. It is known in the prior art to provide exponential decay of all of the filter coefficients in the system. A leakage factor $\gamma$ multiplies one or more previous weights, after passage through one or more delay elements 73, by an exponential decay factor less than one before adding same at summer 75 to the current product of reference signal 42 and error signal 44, Adaptive Signal Processing, Widrow and Stearns, Prentice-Hall, Inc., Engelwood Cliffs, N.J., 1985, pages 376–378, including equations 13.27 and 13.31. In FIG. 1, a variable leakage factor $\gamma$ is provided at 79 and is selectively, adaptively controlled and varied from a maximum value of 1.0 affording maximum control effort and attenuation, to a minimum value such as zero providing minimum control effort and attenuation. Reducing $\gamma$ reduces the signal summed at summer 75 with the product of the reference signal 42 and the error signal 44 from multiplier 72, and hence reduces the weight update signal 74 supplied to model 40. The noted reduction of $\gamma$ increases leakage of the weight update signal.

In FIG. 1, the system and method involves introducing a control signal from output transducer 14 to combine with system input signal 6 and yield system output signal 8, sensing the system output signal with error transducer 16 and providing an error signal 44, providing adaptive filter model 40 having a model input from reference signal 42 correlated to system input signal 6, and an output outputting a correction signal 46 to output transducer 14 to introduce the control signal according to weight update signal 74. A leak signal is provided at 202 which controls the amount of leakage, as above described, and hence controls the amount of degradation of performance of the model. Correction signal 46 is filtered by filter 204 having a transfer characteristic which is a function of a frequency dependent shaped power limitation characteristic, to be described, and then supplied through peak hold circuit 206 and compared at comparator summer 208 against a desired or given peak value provided by a desired peak value signal 210. The output of summer 208 at leak signal 202 controls variable leakage factor $\gamma$ at 79 according to equation (a)

$$\gamma_{k+n}=\gamma_k+\mu e \qquad \text{(a)}$$

where k is the sample number, n is the leak update period, $\mu$ is the step size, and e is the error or leak signal 202. After each sample period n, the peak hold is reset, i.e. set back to zero. The system actively adaptively adjusts the leak based on the output of the adaptive filter model 40 at correction signal 46. The leak adjusts itself to an optimum value as set by desired peak value signal 210.

Figure 14:
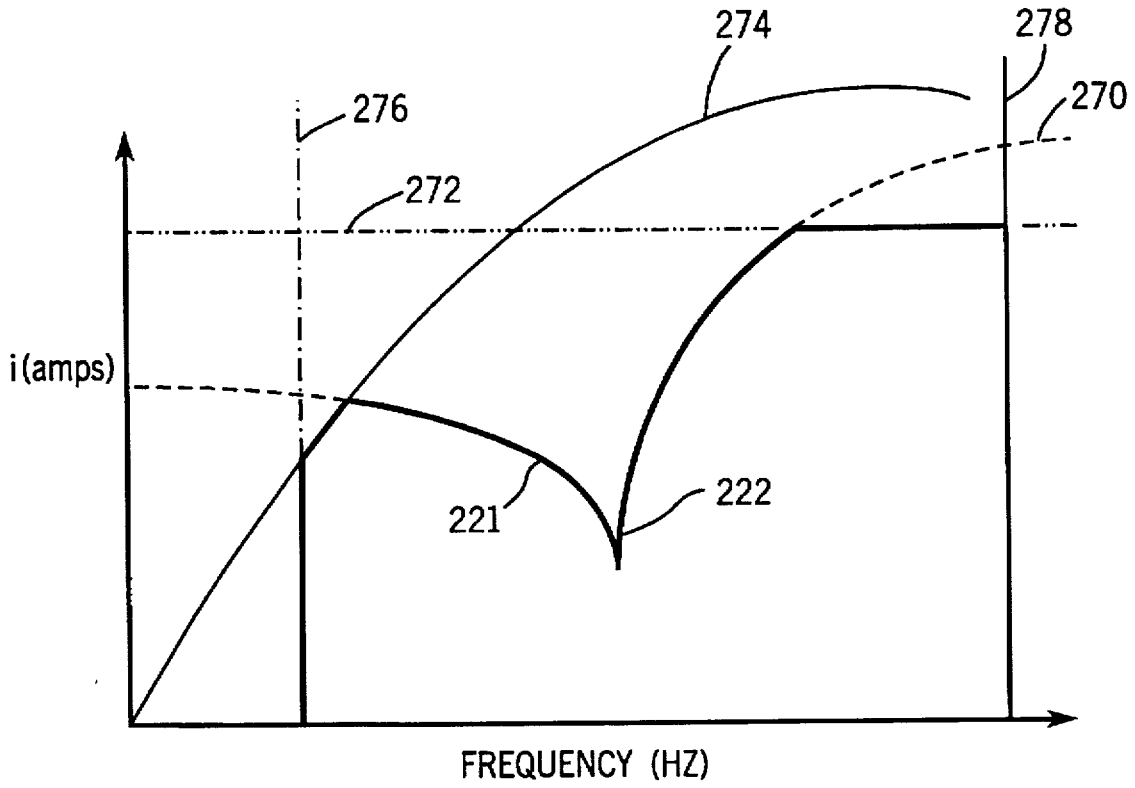
FIG. 14 is a graph illustrating construction of a frequency dependent shaped power limitation characteristic.

FIG. 14 illustrates one exemplary construction of a frequency dependent shaped power limitation characteristic. The correction or output signal to the output transducer or actuator 14, which signal is shown at 214 in FIG. 1, and 242 in FIG. 11, to be described, represents a current which is commanded to drive an actuator. In this embodiment, there are five separate frequency dependent protection limits which collectively limit correction signal 214, FIG. 1, command signal 242, FIG. 11. The first frequency dependent limit 270 represents the current, i in amps, when the output transducer or actuator 14, such as a speaker, inertial actuator or the like, is driven to achieve maximum constant amplitude, i.e. displacement. For example, at the inverse spike or peak 222, very little current is required to achieve the maximum displacement. The second frequency dependent limit 272 represents the maximum peak current, i in amps, i.e. the physical limitation, which the power amplifier 240, FIG. 11, to be described, can deliver. The third frequency dependent limit 274 represents the peak current, i in amps, at which the actuator is dissipating the maximum amount of power available. Limiting the power dissipated by the actuator, resultantly, reduces the operating temperature, and thus, the failure rate of the actuator. The fourth frequency dependent limit 276 represents the "switch on" frequency where it is desired to have no correction signal 46 below that frequency. This protects the actuator or output transducer from being driven outside of its designed frequency range. The fifth frequency dependent limit 278 represents the "switch off" frequency where it is desired to have no correction signal above that frequency. Again, this limits and protects the actuator from being driven outside of its designed frequency range. In this embodiment, the frequency shaped power limitation characteristic 221 is the minimum of all five frequency dependent protection limits to be imposed on correction signal 46. A lesser or greater amount of limits may be implemented. For example, only displacement limits may be used to define the frequency dependent shaped power limitation characteristic.

In FIG. 1, filter 204 is a frequency shaped power limitation characteristic filter. In preferred form, filter 204 is selected to have a transfer characteristic 211 which is the inverse of frequency dependent shaped power limitation characteristic 221 of FIG. 14. Positive peak 212 of filter 204 is the inverse of peak 222 of FIG. 14. In this manner, filter 204 protects output transducer 14 by increasing leakage at resonant or otherwise damaging frequencies, as at notch or spike 212, which increased leakage at such frequency degrades performance of model 40, to minimize the latter's output at 46, to in turn protect against overdriving of output transducer or actuator 14. FIG. 14 illustrates how to determine and construct a frequency dependent shaped power limitation characteristic maximizing usage of available output transducer authority. Filter 204 has a transfer characteristic which is a function of such frequency dependent shaped power limitation characteristic. Weight update signal 74 is adaptively leaked as a function of correction signal 46 above a given peak value according to desired peak value signal 210 such that correction signal 46 adaptively converges to a value limited by the desired peak value at 210. The desired peak value at 210 is selected to be less than peak 212 at resonant frequencies, for example, such that an increase in amplitude of correction signal 46 at a frequency corresponding to peak 212 is permitted to pass through filter 204 and peak hold circuit 206, such that the signal 207 at the minus input of comparator summer 208 exceeds the signal 210 at the plus input, such that comparator summer 208 then has a negative output at 202 to reduce variable leakage factor $\gamma$ at 79 to reduce model output 46 until signal 207 equals signal 210, that is, until signal 202 is minimized, to optimize the amount of leakage of weight update signal 74.

Output transducer 14 and the error path between output transducer 14 and error transducer 16 is modeled with adaptive filter C model 142 having a model input from auxiliary random noise source 140. The output of random noise source 140 is summed at summer 152 with the correction signal from the output of model 40, and the output resultant sum is supplied to output transducer 14, to afford a post-summed correction signal at 214 after passage through summer 152, and a pre-summed correction signal at 46 prior to passage through summer 152. The random noise signal from source 140 is not passed through filter 204. The pre-summed correction signal at 46 is supplied to filter 204, without passing through summer 152.

Figure 2:
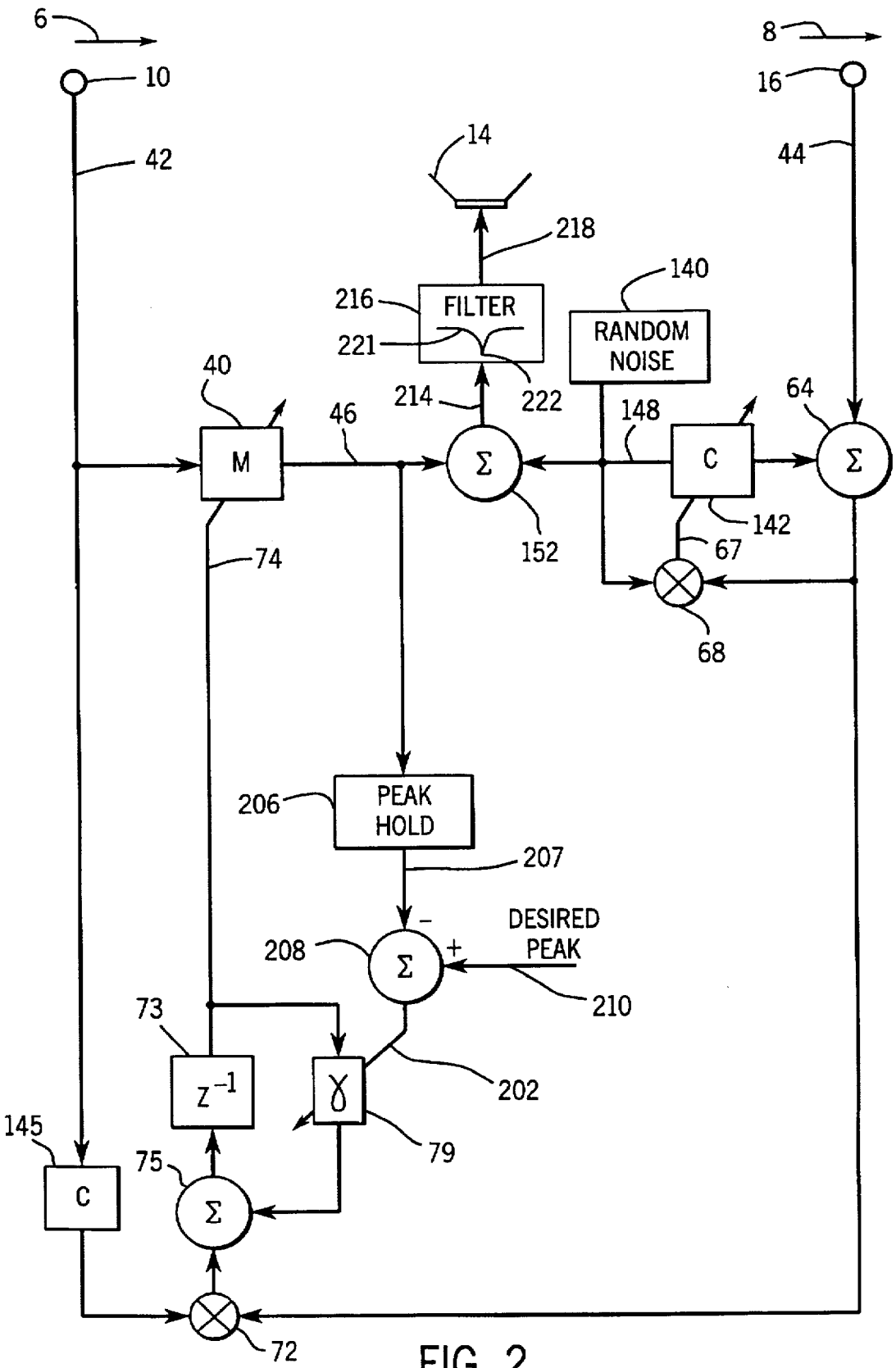
FIG. 2 is similar to FIG. 1 and shows an alternate embodiment.

FIG. 2 uses like reference numerals from above where appropriate to facilitate understanding. In FIG. 2, the correction signal supplied to output transducer 14 is filtered by a frequency shaped power limitation characteristic filter 216. In preferred form, filter 216 is selected to have a transfer characteristic which is a direct function of the frequency dependent shaped power limitation characteristic of FIG. 14, and preferably this characteristic is selected to be characteristic 221 having negative peak 222, to protect output transducer 14, and maximize usage of available output transducer authority. Correction signal 46 from the output of model 40 is supplied through filter 216 to output transducer 14, to afford a post-filtered correction signal at 218 after passage through filter 216, and a pre-filtered correction signal at 46 prior to passage through filter 216. The output of random noise source 140 is summed with pre-filtered correction signal 46 at summer 152, and the resultant sum is supplied to filter 216, to afford a post-summed pre-filtered correction signal at 214 after passage through summer 152 but before passage through filter 216, and a pre-summed pre-filtered correction signal at 46 prior to passage through summer 152. The pre-filtered pre-summed correction signal 46 is supplied through peak hold circuit 206 and compared against desired peak value signal 210 at comparator summer 208 to control adaptive leakage of weight update signal 74.

Filter 216 attenuates the amplitude of the correction signal passing therethrough at frequencies corresponding to inverse spike or peak 222, to protect output transducer or actuator 14 at such frequencies where it may otherwise be damaged or overdriven. Filter 216 protects output transducer 14 against overdriving without waiting for convergence of the adaptive leak process through comparator 208 and leakage factor $\gamma$ at 79. Filter 216 limits the value of the correction signal supplied to output transducer 14 according to a frequency dependent characteristic 221. Weight update signal 74 is adaptively leaked as a function of the correction signal compared against desired peak value signal 210 such that the correction signal from the output of model 40 adaptively converges to a value limited by the peak value of desired peak value signal 210. Filter 216 filters the correction signal 46 supplied to output transducer 14 to protect the latter during the adaptive convergence process.

The advantage of the system of FIG. 2 over the system of FIG. 1 is that the FIG. 2 system provides immediate protection of output transducer 14 without waiting for convergence of the correction signal 46 to desired peak value signal 210. The advantage of the system of FIG. 1 over the system of FIG. 2 is that the FIG. 1 system provides faster convergence of correction signal 46 to desired peak value signal 210 in the frequency ranges of interest.

Figure 3:
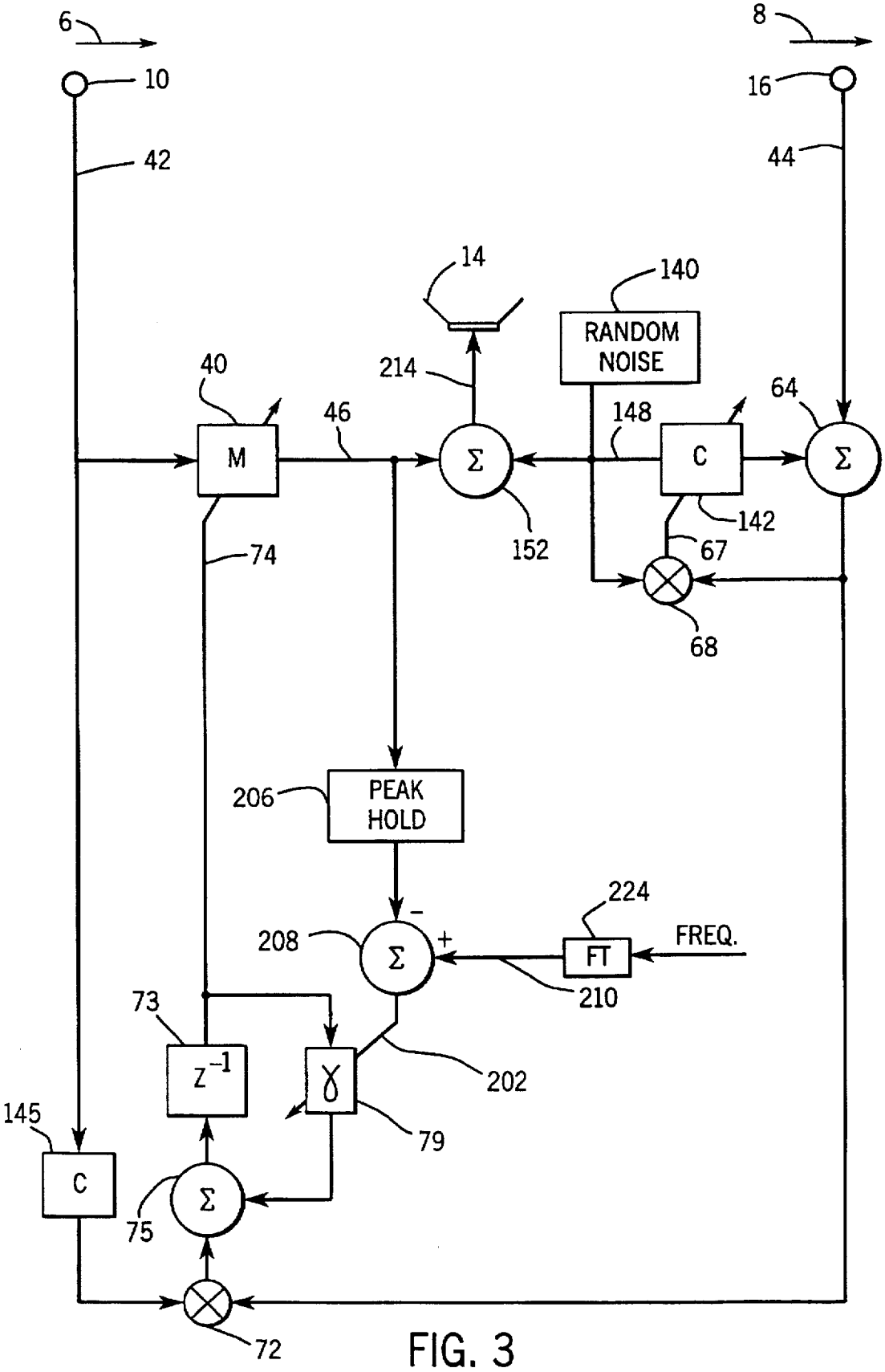
FIG. 3 is similar to FIG. 1 and shows a further embodiment.

FIG. 3 uses like reference numerals from above where appropriate to facilitate understanding. In FIG. 3, desired peak value signal 210 is varied according to frequency. The correction signal from the output of model 40 is compared against desired peak value signal 210 at comparator summer 208 to control adaptive leakage of weight update signal 74, as above. Additionally, a frequency transfer function 224 controls the magnitude of desired peak value signal 210. Frequency transfer function FT at 224 may be a look-up table, a given equation, or another desired frequency transfer function. The pre-summed correction signal 46, prior to passage through summer 152, is supplied through peak hold circuit 206 to comparator summer 208 for comparison against frequency dependent desired peak value signal 210, to control adaptive leakage of weight update signal 74.

Figure 4:
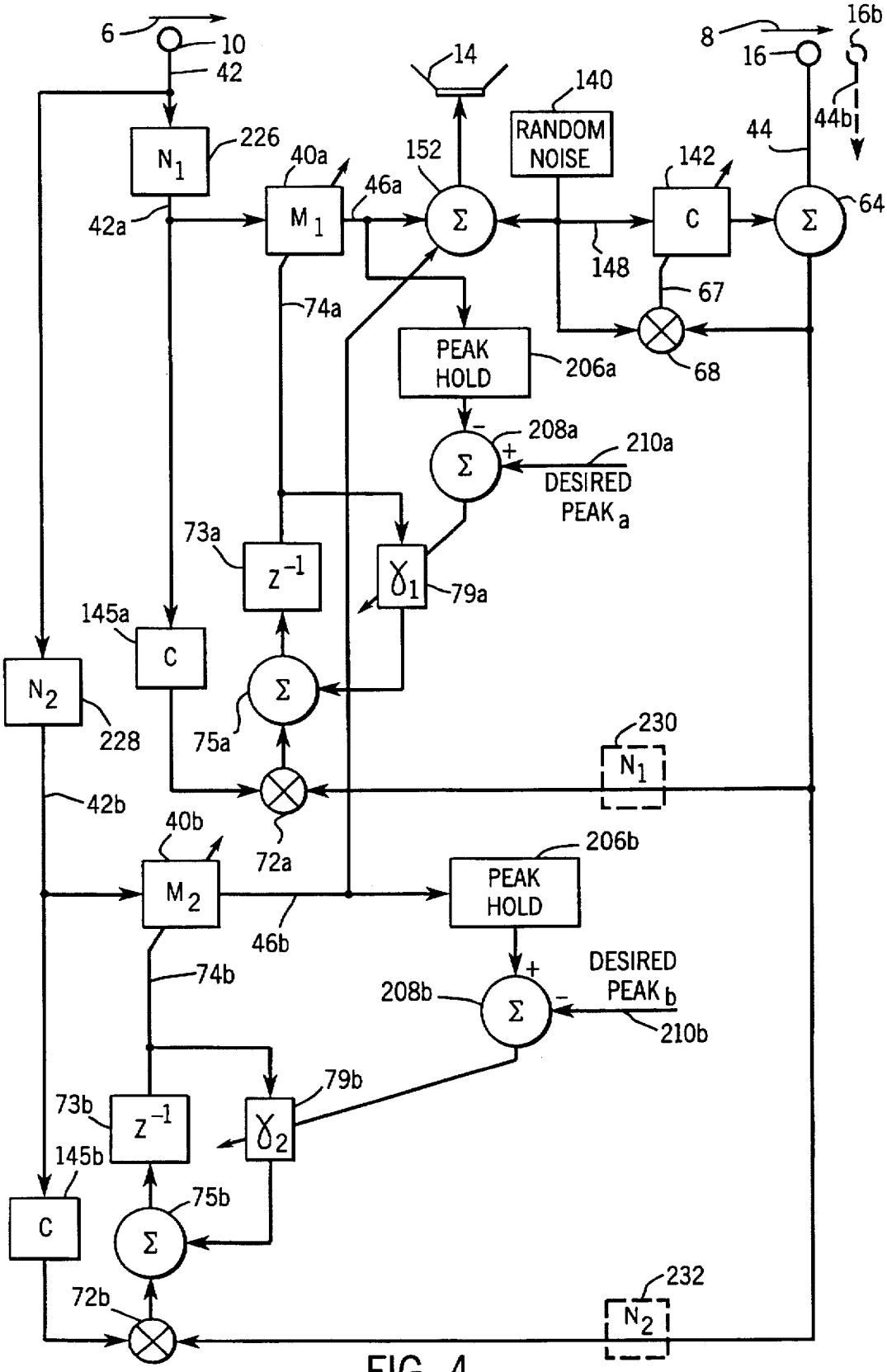
FIG. 4 is a schematic illustration of an active adaptive control system and method in accordance with the invention for a system input signal having a plurality of tones.

FIG. 4 uses like reference numerals from above where appropriate to facilitate understanding, with subscripts a and b. System input signal 42 from input transducer 10 has a plurality of tones, including $N_1$ and $N_2$. The system input signal 42 is separated into $N_1$ and $N_2$ input tones by bandpass filters 226 and 228 to provide input tone signals **42*a* and 42*b* to $M_1$ and $M_2$ adaptive filter models 40*a* and 40*b*, respectively. As above, a control signal is introduced from output transducer 14 to combine with the system input signal and yield a system output signal which is sensed by error transducer 16 providing an error signal 44. Adaptive filter model $M_1$ at 40*a* has a model input from first reference input signal 42*a* correlated to the first input tone, and a model output outputting a correction signal 46*a* through summer 152 to output transducer 14 to introduce the control signal according to weight update signal 74*a*. Reference signal 42*a* is supplied through C model copy 145*a* and combined with the error signal at multiplier 72*a* to provide the weight update signal through summer 75*a* and delay element 73*a*. Weight update signal 74*a* is adaptively leaked as a function of correction signal 46*a* supplied through peak hold circuit 206*a* relative to a peak value according to desired peak value signal 210*a* at comparator summer 208*a* controlling variable leakage factor $\gamma_1$ at 79*a*, such that the correction signal adaptively converges to a value limited by desired peak value signal 210*a*. Adaptive filter model $M_2$ at 40*b* has a model input from input reference signal 42*b* correlated to the second input tone, and a model output outputting correction signal 46*b* through summer 152 to output transducer 14 to introduce the control signal according to weight update signal 74*b*. Reference signal 42*b* is supplied through C model copy 145*b* and combined with the error signal at multiplier 72*b* to provide weight update signal 74*b* through summer 75*b* and delay element 73*b*. Weight update signal 74*b* is adaptively leaked as a function of correction signal 46*b* supplied through peak hold circuit 206*b* relative to a given peak value according to desired peak value signal 210*b* at comparator summer 208*b* having an output controlling variable leakage factor $\gamma_2$ at 79*b*, such that the correction signal adaptively converges to a value limited by desired peak value signal 210*b***.

Figure 5:
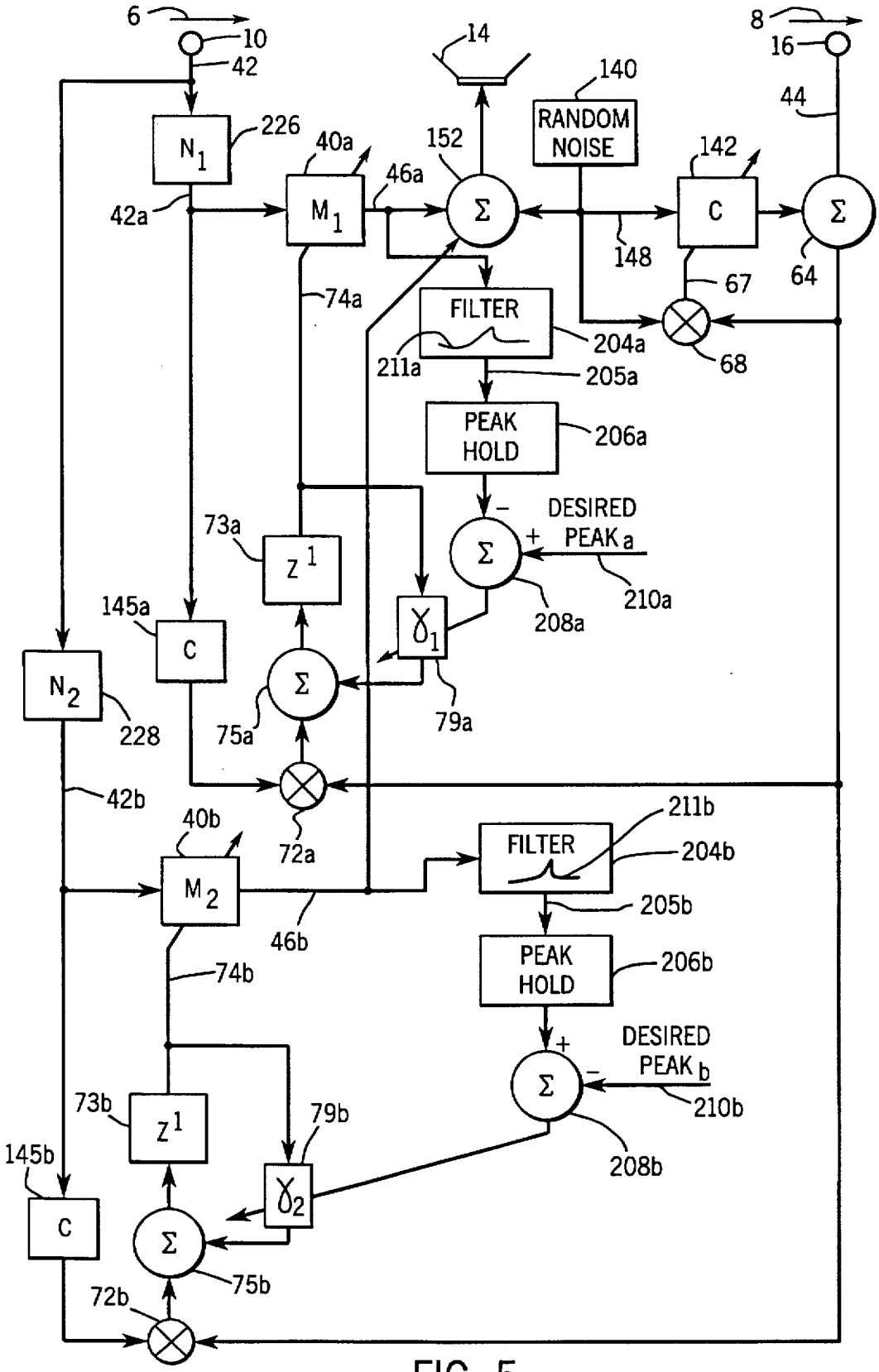
FIG. 5 is similar to FIG. 4 and shows a further embodiment.

FIG. 5 uses like reference numerals from above where appropriate to facilitate understanding. In FIG. 5, each of correction signals **46*a* and 46*b* is filtered with a frequency dependent transfer characteristic at 204*a* and 204*b*, respectively. Correction signals 46*a* and 46*b* are each respectively filtered by filters 204*a* and 204*b* each preferably selected to have a transfer characteristic 211*a* and 211*b* which is the inverse of frequency shaped power limitation characteristic 221 of FIG. 14, to protect output transducer 14 and maximize usage of available output transducer authority. The filter at 204*a* filters correction signal 46*a*, to afford a post-filtered correction signal 205*a* after passage through filter 204*a*, and a pre-filtered correction signal 46*a* prior to passage through filter 204*a*. Filter 204*b* filters correction signal 46*b*, to afford a post-filtered correction signal 205*b* after passage through filter 204*b*, and a pre-filtered correction signal 46*b* prior to passage through filter 204*b*. Post-filtered correction signal 205*a* is supplied through peak hold circuit 206*a* and compared against desired peak value signal 210*a* at comparator summer 208*a* to control adaptive leakage of weight update signal 74*a*. Post-filtered correction signal 205b is supplied through peak hold circuit 206b and compared against desired peak value signal 210b at comparator summer 208b to control adaptive leakage of weight update signal 74b. The pre-filtered correction signals 46a and 46b are summed at summer 152, and the resultant sum is supplied to output transducer 14. The output of random noise source 140 is summed at summer 152 with the pre-filtered correction signals and the resultant sum is supplied to output transducer 14**.

Figure 6:
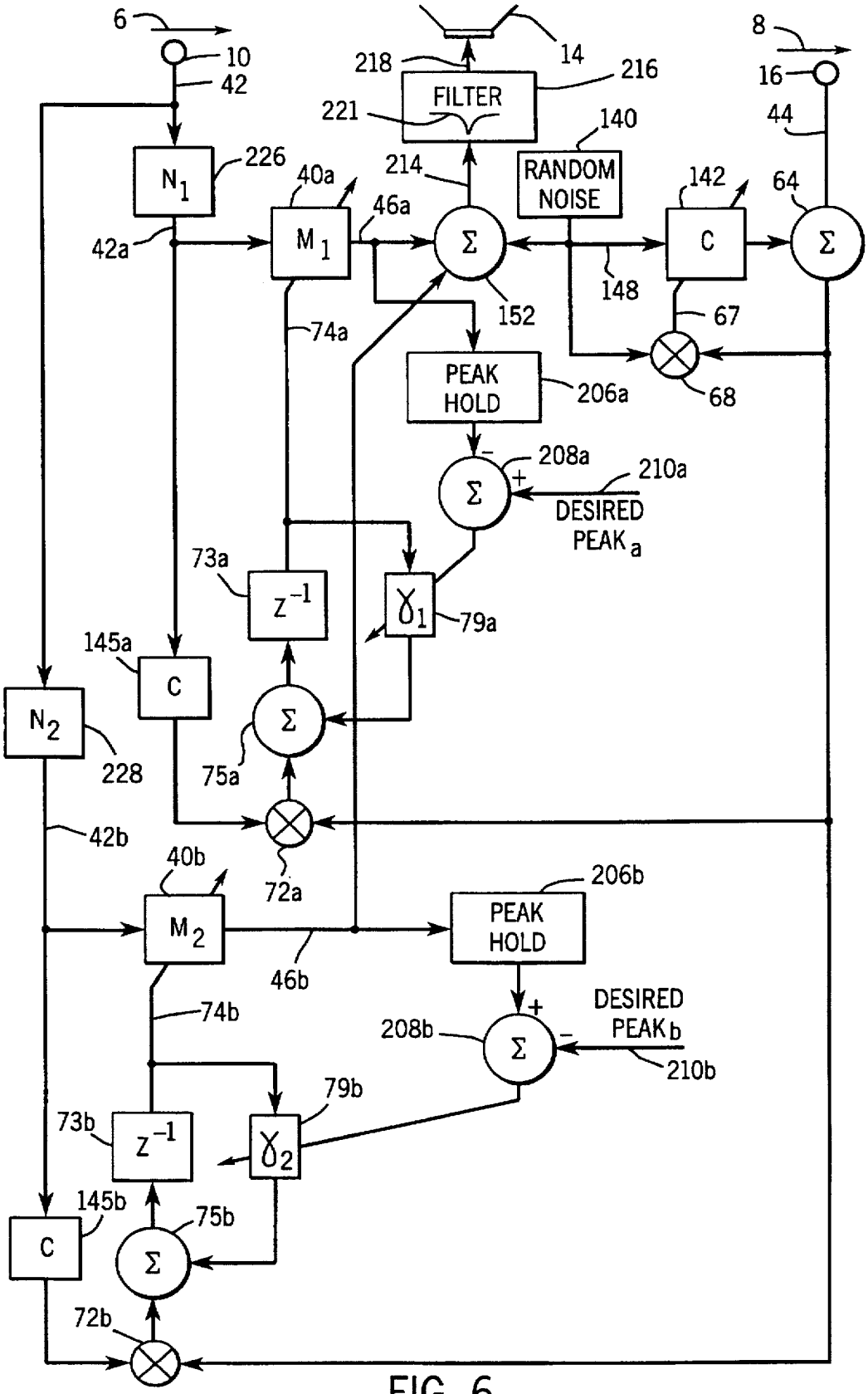
FIG. 6 is similar to FIG. 4 and shows a further embodiment.

FIG. 6 uses like reference numerals from above where appropriate to facilitate understanding. In FIG. 6, the input to output transducer 14 is filtered by filter 216 having a frequency dependent transfer characteristic preferably frequency dependent shaped power limitation characteristic 221 of FIG. 14 or a direct function thereof, to protect output transducer 14, and to maximize usage of available output transducer authority. Correction signals 46a and 46b are summed at summer 152 and the resultant sum is supplied as a summed correction signal 214 to the output transducer. Summed correction signal 214 is filtered by transfer characteristic 221 at filter 216, to provide post-filtered correction signal 218 to output transducer 14.

Figure 7:
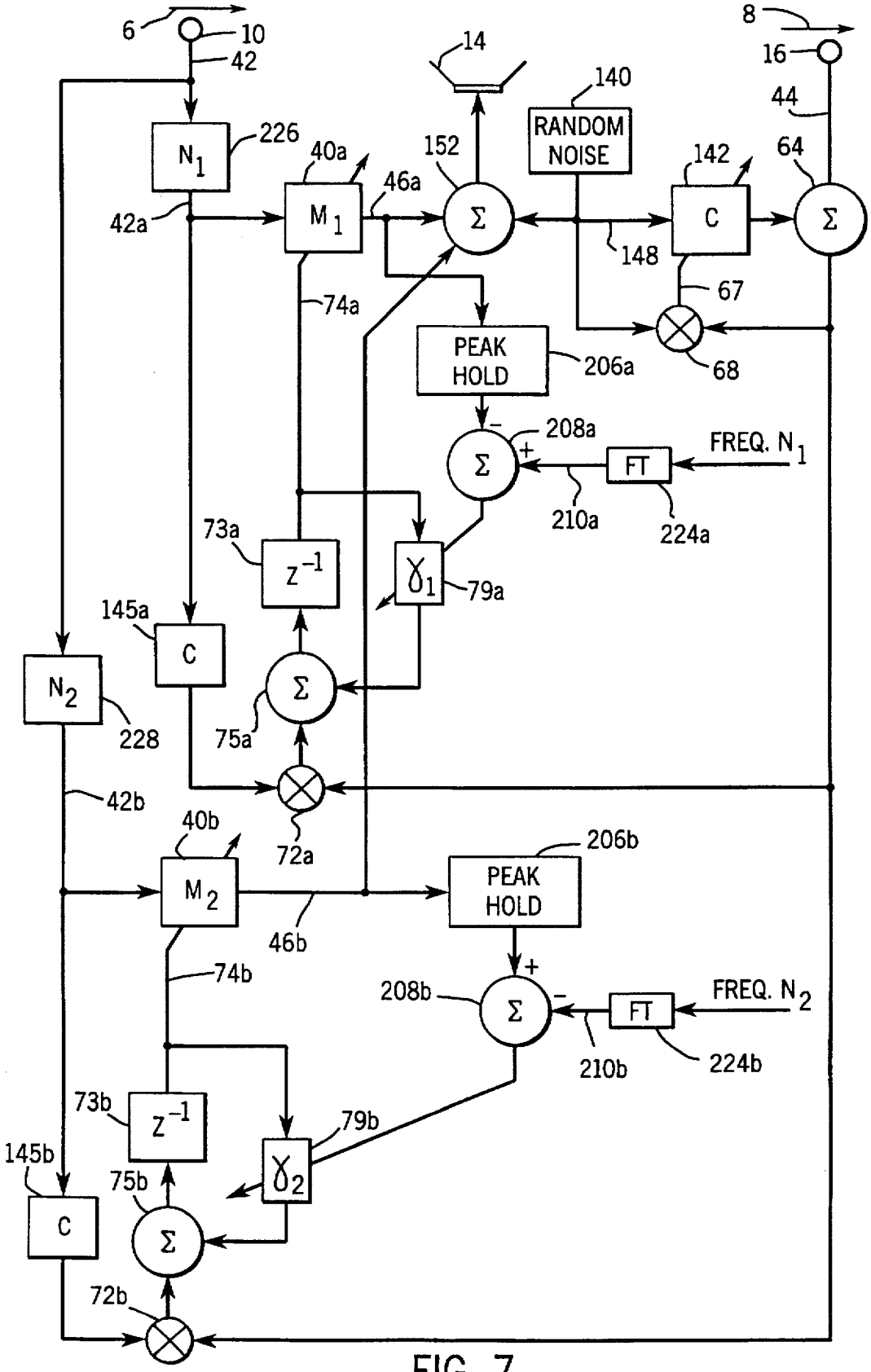
FIG. 7 is similar to FIG. 4 and shows a further embodiment.

FIG. 7 uses like reference numerals from above where appropriate to facilitate understanding. In FIG. 7, desired peak value signals 210a and 210b are varied according to frequency, preferably $N_1$ and $N_2$. Frequency transfer function 224a varies desired peak value signal 210a according to frequency $N_1$. Frequency transfer function 224b varies desired peak value signal 210b according to frequency $N_2$. Pre-summed correction signal 46a, prior to passage through summer 152, is compared against frequency dependent desired peak value signal 210a at comparator summer 208a to control adaptive leakage of weight update signal 74a. Pre-summed correction signal 46b, prior to passage through summer 152, is compared against frequency dependent desired peak value signal 210b at comparator summer 208b to control adaptive leakage of weight update signal 74b.

In alternate embodiments, the error signal is separated into plural tones corresponding respectively to the first and second input tones, for example respective bandpass filters 230 and 232 as shown in dashed line in FIG. 4. Reference signal 42a is combined at multiplier 72a with the error tone from filter 230 to provide weight update signal 74a. Reference input signal 42b is combined at multiplier 72b with the second error tone from filter 232 to provide weight update signal 74b. In a further alternative, the first error tone is provided from a first error transducer 16 providing error signal 44, and the second error tone is provided from a second error transducer 16b providing a second error signal 44b, as shown in dashed line, for first and second models $M_1$ and $M_2$, respectively.

Figure 8:
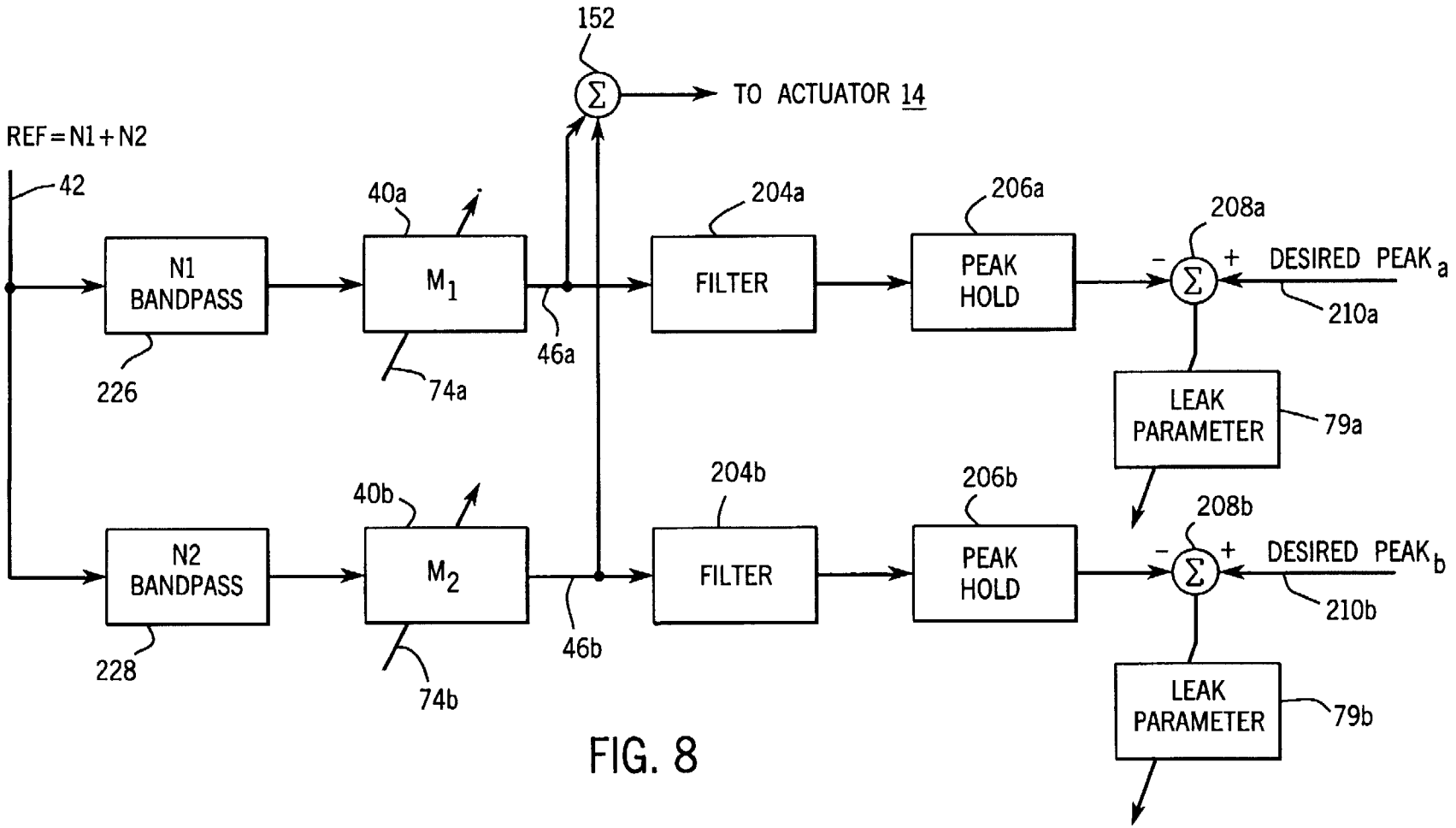
FIG. 8 is another schematic illustration of an active adaptive control system and method in accordance with the invention.

FIG. 8 is an alternate illustration and uses like reference numerals from above where appropriate to facilitate understanding. The correction signals 46a and 46b from the outputs of $M_1$ and $M_2$ models 40a and 40b are filtered by frequency dependent filters 204a and 204b, respectively, each of which is preferably chosen to have transfer characteristic 211. The system of FIG. 8 is for an input signal having a plurality of tones such as $N_1$ and $N_2$.

Figure 9:
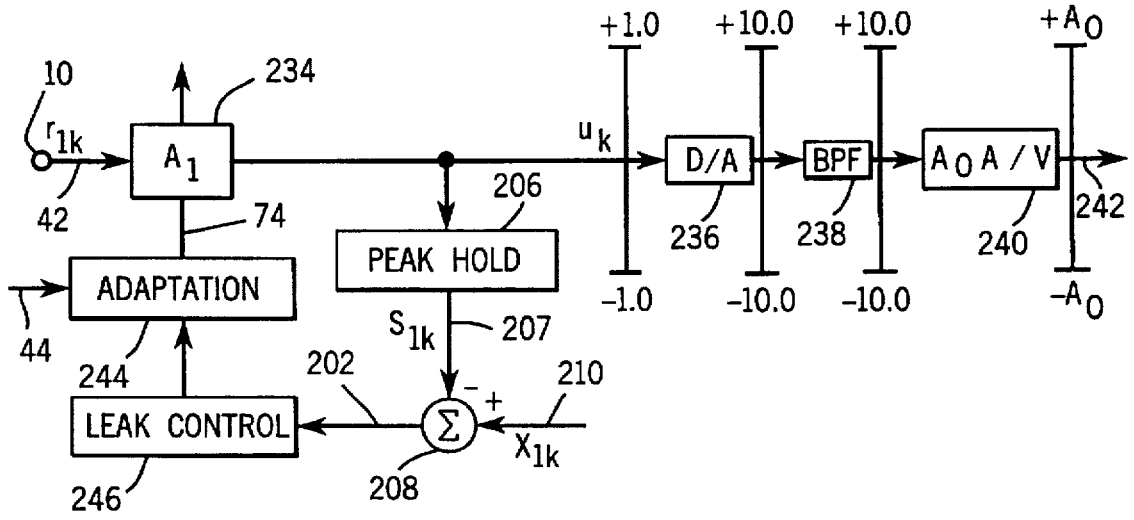
FIG. 9 is another schematic illustration of an active adaptive control system and method in accordance with the invention.

FIG. 9 is an alternate illustration and uses like reference numerals from above where appropriate to facilitate understanding. A reference sensor 10 (e.g. accelerometer, microphone, tachometer) provides a reference input signal $r_{1k}$ at 42 indicative of a tonal disturbance $$r_{1k}=R_1 \cos(2\pi f_1 kT+\phi_1) \quad (1)$$

where $R_1$ is the tone amplitude, $f_1$ is the tone frequency, kT represents the discrete time sampling process with sample period T, and $\phi_1$ is the phase angle. Equation (1) is an example of a signal which only has a single tone present. There could be additional tones as well as broadband noise; however, only low level broadband noise is acceptable.

As indicated in FIG. 9, this reference signal is passed through a control filter A at 234, M at 40 above, to produce the command or correction signal $u_k$ at 46. The command signal will be a tone at the same frequency, but with a different amplitude and phase as the input reference. The control filter model arbitrarily requires this floating-point command signal to be limited within a ±1.0 range. Each $u_k$ sample is passed through a Digital/Analog (D/A) Converter 236 which outputs a voltage signal which is 10× the input sample value. This analog voltage is then passed through a unity gain bandpass filter (BPF) 238 to eliminate high frequency noise due to the discrete sampling process. Finally, this filtered analog control signal is amplified through a power amplifier 240 to produce a current which is proportional to the input voltage signal level. A maximum current of $A_o$ is attained for an input analog voltage of 10 Volts. The output of the amplifier at 242 is supplied to the actuator, for example output transducer or actuator 14 above. Adaptation is controlled by block 244 responsive to error signal 44, and leakage is controlled by block 246 responsive to the output of comparator summer 208, as above.

Figure 10:
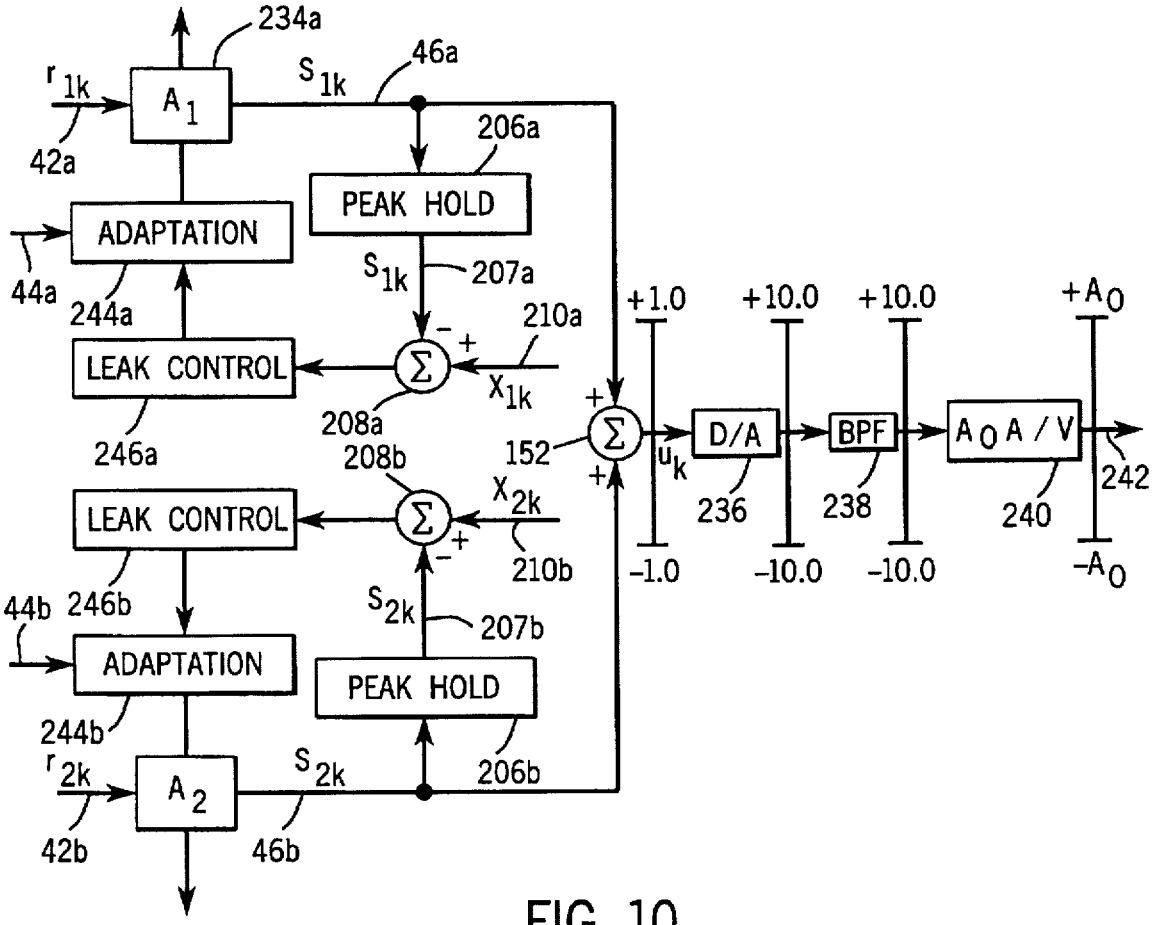
FIG. 10 is similar to FIG. 9 and shows a further embodiment.

FIG. 10 uses like reference numerals from above where appropriate to facilitate understanding. FIG. 10 illustrates modification of the system of FIG. 9 for use when two tones are present in the system input signal. The system limits the power delivered to the actuator or actuators by limiting the power, current or voltage, in a prescribed fashion. A unique power limit is provided for each frequency in the bandwidth of interest. In a further aspect, the system provides arbitration of delivered power between multiple frequencies present in the same control signal, to be described. Each actuator is driven with a command signal containing one or more tones, each of which is limited in amplitude at distinct levels depending on the frequency, according to frequency shaped power limiting. This protects the actuator or actuators against overdriving, while at the same time commanding the maximum or near maximum output therefrom. The actuators are enabled only in the desired control bandwidth. Furthermore, there is a gradual transition from off (out of band) to on (in band) and vice versa, to be described. When two tones $N_1$ and $N_2$ are present in the system input signal, they are separated using appropriate bandpass filters 226 and 228, FIGS. 4 and 8, e.g. a low pass filter and a high pass filter, yielding input reference tone signal $r_{1k}$ at 42a and $r_{2k}$ at 42b, FIG. 10.

The LMS algorithm adapts the coefficients of the A filter, FIG. 9, in order to cancel the error (or errors). The command signal $u_k$ is passed through peak hold circuit 206 which continually updates the observed peak ($S_{1k}$) at 207. This observed peak amplitude is compared at summer 208 with a desired amplitude ($X_{1k}$) provided by desired peak value signal 210 which is specified by the designer as a limit or threshold. The difference between the estimated amplitude at 207 and the desired limit at 210 is used by the leak control block 246 to adjust the amount of leak applied to the A filter update 74. Increasing the amount of leak has the effect of reducing the control filter coefficients and thereby reducing the command or correction signal amplitude at 46. In some applications, alternate reference sensor types and/or locations may exist which only have the individual tones present. This would eliminate the need for $N_1$ and $N_2$ filters; however, it would require additional reference sensors.

In the case of a single reference signal containing two tones, two separate filters $N_1$ and $N_2$ are used to produce the following signals $$r_{1k}=R_1 \cos(2\pi f_1 kT+\phi_1) \quad (2)$$

$$r_{2k}=R_2 \cos(2\pi f_2 kT+\phi_2) \quad (3)$$

Corresponding to each reference input, there are two control filters $A_1$ and $A_2$ at 234a and 234b in FIG. 10, which are $M_1$ and $M_2$ at 40a and 40b above. The outputs from each of these filters at 46a and 46b are, respectively $$s_{1k}=S_1 \cos(2\pi f_1 kT+\theta_1) \quad (4)$$

$$s_{2k}=S_{2k} \cos(2\pi f_2 kT+\theta_2) \quad (5)$$

where $S_{1k}$ and $S_{2k}$ are the tone amplitudes, $f_1$ and $f_2$ are the tone frequencies, and $\theta_1$ and $\theta_2$ are the phase angles of the control tones.

Each A filter 234a and 234b has its own adaptation update block 244a and 244b, respectively, as well as its own leak control block 246a and 246b, respectively, and peak hold block 206a and 206b, respectively. The peak limits for each tone are $X_{1k}$ at 210a and $X_{2k}$ at 210b. As described above, the leak control block acts to insure that the following constraints are always satisfied $$0 \leqq S_{1k} \leqq X_{1k} \leqq 1.0 \quad (6)$$

$$0 \leqq S_{2k} \leqq X_{2k} \leqq 1.0 \quad (7)$$

The total cumulative correction or command signal is the sum of the two A filter outputs 46a and 46b at the output of summer 152

$$u_k=S_{1k} \cos(2\pi f_1 kT+_1)+S_{2k} \cos(2\pi f_2 kT+\theta_2) \quad (8)$$

The remainder of the path in FIG. 10 is as described above.

Some applications require frequency dependent limits for $X_{1k}$ and $X_{2k}$. In some applications, explicit knowledge of the proportions of the disturbance frequencies $f_1$ and $f_2$ is unavailable, and therefore the limits cannot be optimally set. The limits must either be set too conservatively, or the actuator and associated power amplifier must be oversized. Both of these options generally lead to uneconomical designs.

Figure 11:
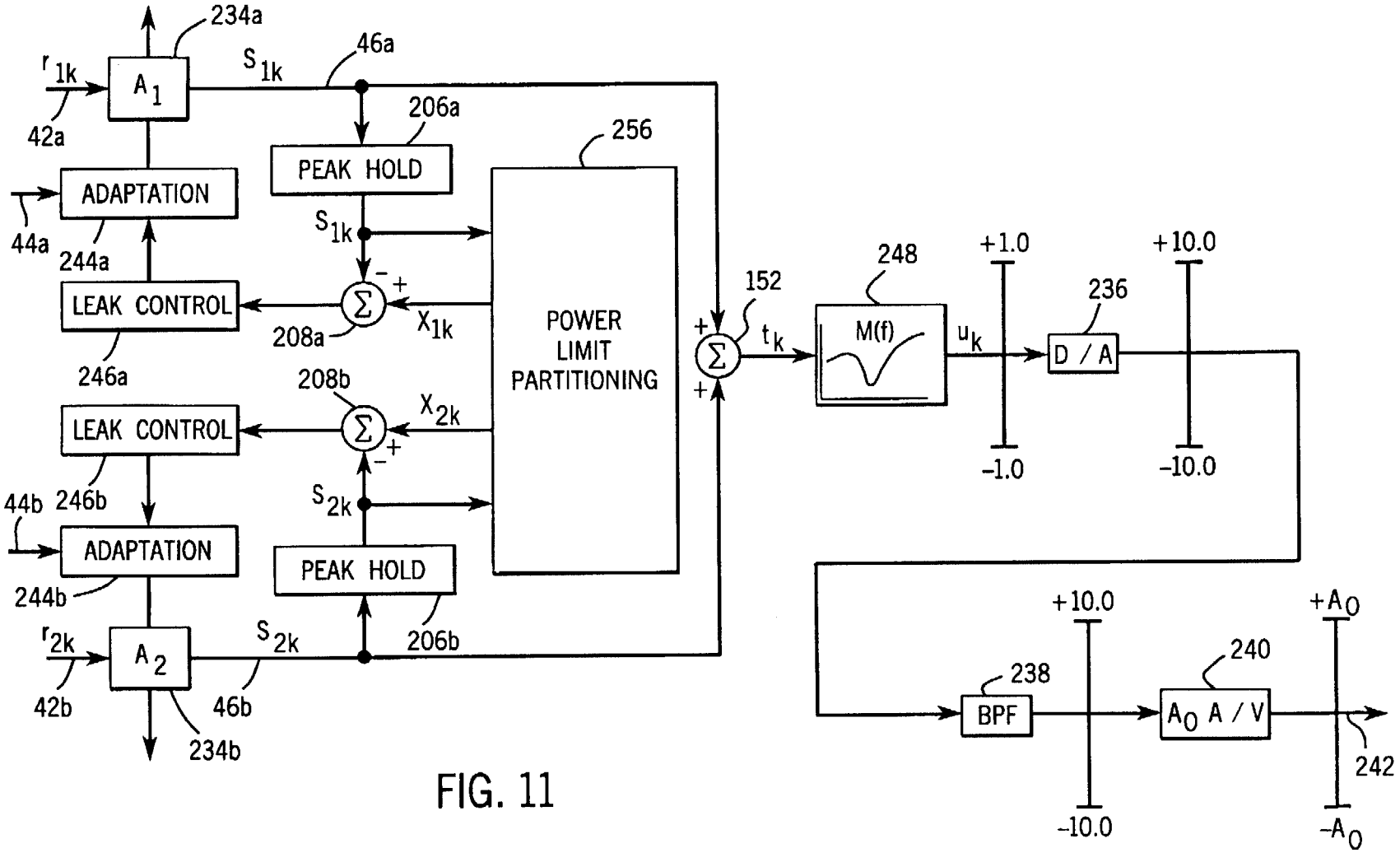
FIG. 11 is similar to FIG. 10 and shows a further embodiment.

FIG. 11 shows further modifications of the system of FIG. 10, and uses like reference numerals from above where appropriate to facilitate understanding. In FIG. 11, the post-summed command or correction signal $t_k$ at 214 is given by $$t_k=s_{1k}+s_{2k}=S_{1k} \cos(2\pi f_1 kT+\theta_1)+S_{2k} \cos(2\pi f_2 kT+\theta_2) \quad (9)$$

This command signal $t_k$ at 214 is passed through an filter 248 having a frequency dependent transfer characteristic, which corresponds to filter 216 above, and which can be an IIR (Infinite Impulse Response) or FIR (Finite Impulse Response) digital filter. It is possible to construct the filter 248 using analog circuitry, in which case it would be placed after the D/A converter or incorporated as part of the band-pass filter. Since this would reduce the flexibility to modify the transfer function as well as increase the cost of the analog filtering, it is not a preferred option.

The filter 248 can be represented in the frequency domain as $$M(f) \equiv [M(f)e^{jn(f)}] = \Im\left(\frac{\text{num}(z)}{\text{den}(z)}\right) \quad (10)$$

where $M(f)$ is the magnitude response and $n(f)$ is the phase response, and $\Im$ is the z-transform operator. The digital filter coefficients are selected such that the magnitude response $M(f)$ is a normalized representation of the frequency dependent transfer characteristic EF.

The output $U_k$ at 218 of filter 248 is given by $$u_k=M(f_1)S_{1k} \cos(2\pi f_1 kT+\psi_1)+M(f_2)S_{2k} \cos(2\pi f_2 kT+\psi_2) \quad (11)$$

where $\psi_1$ and $\psi_2$ are the phase angles of the tones in the command signal. In order to insure that neither the D/A or the current amplifier saturates (i.e. they are commanded to exceed their physical capability), the following equation must be satisfied $$\|u_k\|=[M(f_1)S_{1k}+M(f_2)S_{2k}] \leqq 1.0 \quad (12)$$

The magnitude function $M(f)$ at 248 is selected such that: only a single tone is assumed to be passing through the filter; $A_o \times M(f)$ is the desired maximum peak current limit at the frequency $f$ as defined by the frequency dependent transfer characteristic 221; and the magnitude is bounded as: $0 \leqq M(f) \leqq 1$. This design criteria along with equation (1) requires that $$S_{2k}=0 \rightarrow 0 \leqq S_{1k} \leqq 1.0 \quad (13)$$

$$S_{1k}=0 \rightarrow 0 \leqq S_{2k} \leqq 1.0 \quad (14)$$

thus establishing a greatest upper bound on the A filter output signals. This is the justification for choosing the upper bound in constraint equation (1).

At a given frequency, the magnitude function $M(f)$ can be interpreted as a specified or desired limit for the %-of-full-scale output current at frequency $f$, where 1.0 corresponds to 100% full scale current $A_o$, etc. From the physical constraint equation (12), full designed authority is possible on both tones if $$(M(f_1)+M(f_2)) \leqq 1 \quad (15)$$

The maximum current $A_o$ should be designed along with $M(f)$ such that equation (15) is always satisfied for any likely frequencies $f_1$ and $f_2$. If equation (15) were always satisfied for the given tones, then one could simply select $X_1=X_2=1$ and there would be no real need for power limit partitioning. The shaping filter would automatically limit the tones in such a way that the command signal would never exceed any physical saturation limits. For economic reasons, equation (15) is not always satisfied. Usually this occurs when the power amplifier is undersized or the actuator is undersized.

Violating constraint equation (15) leads to the requirement for a power limit partitioning function. The objective of power limit partitioning is to select and continuously adjust $X_1$ and $X_2$ such that constraint equation (12) is always satisfied. When equation (15) is not satisfied, there is not enough current for both tones to achieve their maximum desired current amplitude. The current must be "shared" between the two tones in a specified way.

Figure 12:
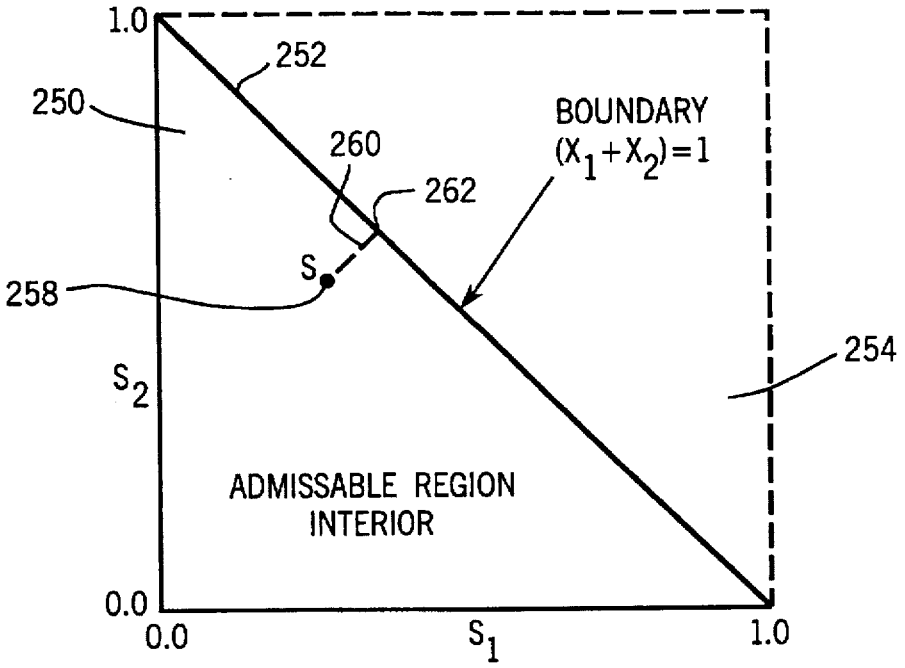
FIG. 12 is a graph illustrating implementation of the power limit partitioning aspect of the system of FIG. 11.

The operation of the power limit partitioning function will first be discussed with reference to possible scenarios. First, we define $S=(S_1,S_2)$ as the point whose x and y coordinates are the current tone amplitudes for each tone respectively; and define $X=(X_1,X_2)$ as the point whose x and y coordinates are the current tone amplitude limits for each tone respectively. From equation (1), the domain of these points is the unit square. To illustrate this concept, we look at a simple example where the shape function has been specified such that each tone is allowed to have maximum current. Both tones cannot have maximum current at the same time. FIG. 12 represents this example case where $$M(f_1)=M(f_2)=1. \quad (16)$$

Substituting this condition into the constraint equation (12), it is seen that all points S are restricted to a region called the admissable region 250, FIG. 12. All points X are restricted to the boundary 252 of this region. For this particular example, any point S in the admissable region will satisfy the constraints given by equation (12). Any point S outside the admissable region at exterior region 254 will require more current than can be delivered. Any point S on the boundary 252 of the admissable region will require exactly the maximum current. Points outside the admissable region represent lost authority because the tones must share current. This simple example demonstrates the interdependence of $X_1$ and $X_2$. A simple but very restrictive way to eliminate the interdependence is to select $X_1=X_2=0.5$.

If $M(f_1)$ and $M(f_2)$ are known explicitly, the power limit partitioning block 256, FIG. 11, can determine $X_1$ and $X_2$ by simply projecting each new point S at 258, FIG. 12, up to the boundary 252 of the admissable region 250 on a perpendicular line 260 or in some other fashion. This is a simple geometric transformation which is the solution to the following linear system of equations constrained by equation (1).

$$\begin{bmatrix} M(f_2) & -M(f_1) \\ M(f_1) & M(f_2) \end{bmatrix} \begin{bmatrix} X_1 \\ X_2 \end{bmatrix} = \begin{bmatrix} S_1M(f_2) - S_2M(f_1) \\ 1 \end{bmatrix} \tag{17}$$

The above system adaptively partitions the power levels between the $N_1$ and $N_2$ tone signals 46*a* and 46*b*. The partitioning is related to the frequency shaping technique used for limiting the output transducer or actuator authority as a function of frequency. Using constant levels in the partitioning leads to a very conservative and not fully used control system. Partitioning strategy using variable levels for desired peak value signals 210*a* and 210*b* allows a more liberal use of the available actuator authority while maintaining appropriate limitations. This is achieved by adaptive power limit partitioning.

The system of FIG. 11 operates two parallel cancellation filters 234*a* and 234*b* for actuator 14. The system input signal is separated into $N_1$ and $N_2$ component tones at input reference signal $r_{1k}$ at 42*a* and input reference signal $r_{2k}$ at 42*b*. These reference signals are then filtered through adaptive filters $A_1$ at 234*a* and $A_2$ at 234*b*, respectively. Separate adaptation processes adjust the magnitude and phase of the reference signals to produce the desired cancellation signal at 242 at actuator 14. In some applications, the actuators require different current amplitude limits at each frequency in the control bandwidth. These current amplitude limits are encoded in the magnitude response $M(f)$ of the filter 248. The filter 248 is selected such that a single unity amplitude tone from one of the A filters 234*a* and 234*b* will produce a sinusoidal control current waveform whose amplitude is at the maximum limit for that frequency assuming that no other tones or noise are present in the control signal. The frequency selective active adaptive control system is enhanced if the reference signals have a high signal to noise ratio. If not, any noise in the reference signal acts to reduce the available authority at the $N_1$ and $N_2$ control waveforms.

Power limit partitioning adjusts the maximum peak limits $X_{1k}$ and $X_{2k}$ of the desired peak value signals 210*a* and 210*b*, respectively, in order to utilize as much actuator authority as possible. If only one tone is present, there is no need for power limit partitioning. Power limit partitioning should desirably grant authority to the $N_1$ or $N_2$ control tone as required. For example, if the A filter models determine that the $N_1$ control tone must be close to its maximum limit, the partitioning should reduce the limit for $N_2$ in order to increase the limit for $N_1$. In the event that both tones require more authority than is available, the partitioning should optimize the relative authority between the two tones while maintaining a safe operation.

Filter 248 is selected such that the peak values and maximum limits are constrained within the unit square, equations (6) and (7) above. Equations (6) and (7) represent a general requirement which must be satisfied, but offer no information as to how energy should be partitioned between the two tones. One partitioning scheme which is much less restrictive than constant limits, but still somewhat conservative, is to restrict the peak values to lie in the lower triangular region of the unit square as shown in FIG. 12. The maximum peak limits are restricted to the diagonal boundary 252 of the admissable region 250. One method for adjusting the maximum limits $X=(X_1,X_2)$ is projecting the current peak values $S=(S_1,S_2)$ to the admissable region boundary 252 along a perpendicular line 260, FIG. 12. Each time a new set of peak values are obtained or updated, the following projection algorithm equations are used to determine the new maximum limits $$X_{1k}=\tfrac{1}{2}(S_{1k}-S_{2k}+1) \tag{18}$$

$$X_{2k}=(1-X_{1k}) \tag{19}$$

By construction, these limits will always reside on the boundary 252 of the admissable region 250, FIG. 12. The limit values computed from equations (18) and (19) represent the projection of S from point 258 along a perpendicular 260 to the boundary 252. For all interior points (S) in the admissable region 250, equations (18) and (19) insure that the limits are always chosen greater than or equal to the current peak values.

An interesting phenomenon occurs when the "optimal" peak values (i.e. the steady-state peak levels which would be obtained if no limits were in place) lie outside the admissable region. This condition is likely to be very common. In this case, the S-trajectory would approach and contact the boundary after a certain period of time. Assuming that the peak amplitudes then remain constant, the algorithm given by equations (18) and (19) would cause the trajectory to "stick" on the boundary at the point of contact. This is generally an undesirable condition.

There are two naturally occurring phenomena which prevent this sticking condition. First, the implemented peak detection measurement process is slightly noisy due to the noise present in the reference signal which does pass through the A filter. Second, the peak values are only updated once per block of data. Trajectories can actually evolve outside the admissable region for a period of time until the leak control has a chance to increase the leak. How far the trajectories travel outside the admissable region is dependent on the adaptation rate of the A filters and the amount of leak present.

These facts allow trajectories to evolve "along" the boundary as a sliding mode from the theory of variable structure systems, "Variable Structure Systems With Sliding Modes", V. I. Utkin, IEEE Transactions on Automatic Control, Vol. AC-22, No. 2, April, 1977, pp. 212–222. Assuming that the LMS adaptation algorithm continues to drive the $N_1$ and the $N_2$ control tone amplitudes to their optimal (but not admissable) levels, a unique equilibrium point will exist on the boundary along a perpendicular to the "optimal" peak point, assuming a normalized error surface. As with variable structure systems in general, we must tolerate the potential oscillations of the trajectory around and along the boundary.

Figure 13:
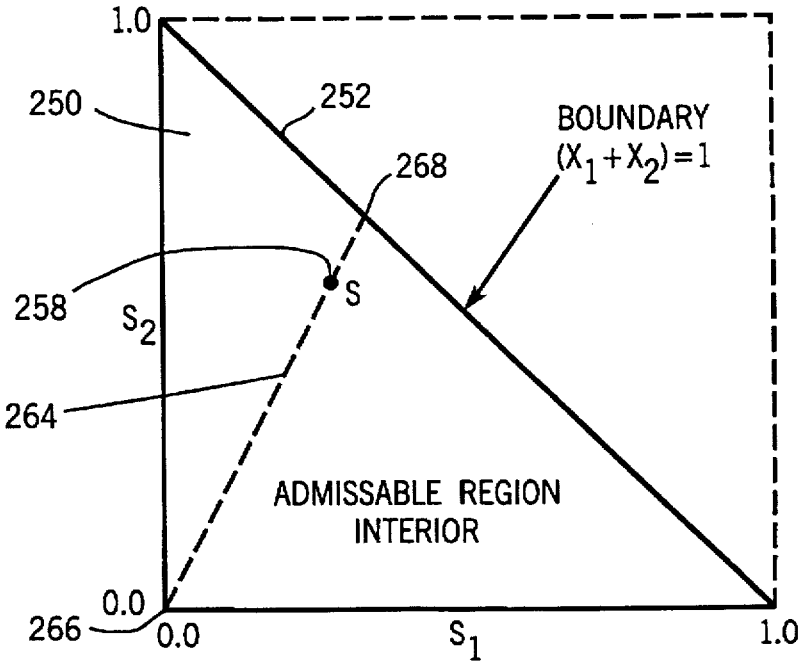
FIG. 13 is a graph illustrating alternate implementation of the power limit partitioning aspect of the system of FIG. 11.

The above method selects the limits for $X_1$ and $X_2$, for variably balancing leakage of the first and second weight update signals 74a and 74b to partition power distribution among the first and second correction signals 46a and 46b to limit cumulative power to output transducer 14. An admissable region 250 of values in a plot of the first correction signal versus the second correction signal is determined, and control of leakage of the first and second weight update signals is coordinated to maintain the first and second correction signals in the admissable region. The boundary of the admissable region is determined along a boundary line 252 according to the sum of the first and second correction signals being equal to a predetermined maximum value. The optimum point 262 on the boundary line is determined for balancing the first and second desired peak value signals from a starting point 258 off of boundary line 252 by projecting from starting point 258 to boundary line 252 along a projection line 260 intersecting and perpendicular to boundary line 252. The intersection of projection line 260 and boundary line 252 is the noted optimum point 260. It is preferred that the first and second correction signals be maintained on the boundary line. In an alternate method, FIG. 13, the boundary of admissable region 250 is determined along a boundary line 252, and the optimum point on the boundary line for balancing the first and second peak value signals from a starting point 258 off of boundary line 252 is determined by projecting from starting point 258 to the boundary line along a projection line 264 extending from the origin 266 of the plot through starting point 258 and intersecting boundary line 252. The intersection of projection line 264 and boundary line 252 is the noted optimum point 268. In another alternative, if the error surface around the starting point can be determined, a projection from the starting point to the boundary line along a projection line intersecting the boundary line and tangent to the error surface is determined, and the intersection of such projection line and the boundary line is the optimum point.

The present subject matter may be used in multi-channel applications, for example U.S. Pat. Nos. 5,216,721 and 5,216,722, incorporated herein by reference, for example using a plurality of the systems disclosed herein, one for each of a plurality of actuators.

It is recognized that various equivalents, alternatives and modifications are possible within the scope of the appended claims.

We claim:

1. An active adaptive control method comprising introducing a control signal from an output transducer to combine with a system input signal and yield a system output signal, sensing said system output signal with an error transducer providing an error signal, providing an adaptive filter model having a model input from a reference signal correlated to said system input signal, and a model output outputting a correction signal to said output transducer to introduce said control signal according to a weight update signal, adaptively leaking said weight update signal as a function of said correction signal relative to a given peak value according to a desired peak value signal such that said correction signal adaptively converges to a value limited by said peak value, filtering said correction signal by a filter having a transfer characteristic which is a function of a frequency dependent shaped power limitation characteristic maximizing usage of available output transducer authority.

2. The method according to claim 1 wherein said transfer characteristic of said filter is an inverse function of said frequency dependent shaped power limitation characteristic.

3. The method according to claim 2 wherein said transfer characteristic of said filter is the inverse of said frequency dependent shaped power limitation characteristic.

4. The method according to claim 2 comprising comparing said correction signal against said desired peak value signal at a comparator to control adaptive leakage of said weight update signal, and supplying said correction signal to said comparator through said filter.

5. The method according to claim 4 comprising modeling said output transducer and the error path between said output transducer and said error transducer with a second adaptive filter model having a model input from an auxiliary noise source uncorrelated with said system input signal, summing the output of said auxiliary noise source and said correction signal from said model output of said first model and supplying the resultant sum to said output transducer, to afford a post-summed correction signal after passage through said summer, and a pre-summed correction signal prior to passage through said summer, comparing said pre-summed correction signal against said desired peak value signal at said comparator to control adaptive leakage of said weight update signal, filtering said pre-summed correction signal through said filter prior to said comparing.

6. The method according to claim 1 wherein said transfer characteristic of said filter is a direct function of said frequency dependent shaped power limitation characteristic.

7. The method according to claim 6 wherein said transfer characteristic of said filter is said frequency dependent shaped power limitation characteristic.

8. The method according to claim 6 comprising supplying said correction signal through said filter to said output transducer, to afford a post-filtered correction signal after passage through said filter, and a pre-filtered correction signal prior to passage through said filter, comparing said pre-filtered correction signal against said desired peak value signal at a comparator to control adaptive leakage of said weight update signal.

9. The method according to claim 8 comprising modeling said output transducer and the error path between said output transducer and said error transducer with a second adaptive filter model having a model input from an auxiliary noise source uncorrelated with said system input signal, summing the output of said auxiliary noise source and said pre-filtered correction signal from said model output of said first model and supplying the resultant sum to said filter, to afford a post-summed pre-filtered correction signal after passage through said summer and prior to passage through said filter, and a pre-summed pre-filtered correction signal prior to passage through said summer and prior to passage through said filter, comparing said pre-filtered pre-summed correction signal against said desired peak value signal at said comparator to control adaptive leakage of said weight update signal.

10. An active adaptive control method comprising introducing a control signal from an output transducer to combine with a system input signal and yield a system output signal, sensing said system output signal with an error transducer providing an error signal, providing an adaptive filter model having a model input from a reference signal correlated to said system input signal, and a model output outputting a correction signal to said output transducer to introduce said control signal according to a weight update signal, adaptively leaking said weight update signal as a function of said correction signal relative to a given peak value according to a desired peak value signal such that said correction signal adaptively converges to a value limited by said peak value, varying said desired peak value signal according to frequency.

11. The method according to claim 10 comprising comparing said correction signal against said desired peak value signal at a comparator to control adaptive leakage of said weight update signal, providing a frequency transfer function controlling said peak value of said desired peak value signal.

12. The method according to claim 10 comprising modeling said output transducer and the error path between said output transducer and said error transducer with a second adaptive filter model having a model input from an auxiliary noise source uncorrelated with said system input signal, summing the output of said auxiliary noise source and said correction signal from said model output, to afford a post-summed correction signal after said summing, and a pre-summed correction signal prior to said summing, supplying said post-summed correction signal to said output transducer, comparing said pre-summed correction signal against said desired peak value signal at a comparator to control adaptive leakage of said weight update signal.

13. An active adaptive control method for a system input signal having a plurality of tones, comprising separating said system input signal into at least first and second input tones, introducing a control signal from an output transducer to combine with said system input signal and yield a system output signal, sensing said system output signal with an error transducer providing an error signal, providing a first adaptive filter model having a model input from a first reference signal correlated to said first input tone, and a model output outputting a first correction signal to said output transducer to introduce said control signal according to a first weight update signal, adaptively leaking said first weight update signal as a function of said first correction signal relative to a first given peak value according to a first desired peak value signal such that said first correction signal adaptively converges to a value limited by said first peak value, providing a second adaptive filter model having a model input from a second reference signal correlated to said second input tone, and a model output outputting a second correction signal to said output transducer to introduce said control signal according to a second weight update signal, adaptively leaking said second weight update signal as a function of said second correction signal relative to a second given peak value according to a second desired peak value signal such that said second correction signal adaptively converges to a value limited by said second peak value.

14. The method according to claim 13 comprising filtering each of said first and second correction signals with a frequency dependent transfer characteristic.

15. The method according to claim 14 comprising determining a frequency dependent shaped power limitation characteristic maximizing usage of available output transducer authority, and filtering each of said first and second correction signals with a filter having a transfer characteristic which is a function of said frequency dependent shaped power limitation characteristic.

16. The method according to claim 15 wherein each of said filters has a transfer characteristic which is an inverse function of said frequency dependent shaped power limitation characteristic.

17. The method according to claim 15 comprising providing a first said filter filtering said first correction signal, to afford a post-filtered first correction signal after passage through said first filter, and a pre-filtered first correction signal prior to passage through said first filter, providing a second filter filtering said second correction signal, to afford a post-filtered second correction signal after passage through said second filter, and a pre-filtered second correction signal prior to passage through said second filter, comparing said first post-filtered correction signal against said first desired peak value signal at a first comparator to control adaptive leakage of said first weight update signal, comparing said second post-filtered correction signal against said second desired peak value signal at a second comparator to control adaptive leakage of said second weight update signal.

18. The method according to claim 17 comprising summing said first and second pre-filtered correction signals and supplying the resultant sum to said output transducer.

19. The method according to claim 17 comprising modeling said output transducer and the error path between said output transducer and said error transducer with a third adaptive filter model having a model input from an auxiliary noise source uncorrelated with said system input signal, and summing the output of said auxiliary noise source with said first and second pre-filtered correction signals and supplying the resultant sum to said output transducer.

20. The method according to claim 13 comprising filtering the input to said output transducer with a frequency dependent transfer characteristic.

21. The method according to claim 20 comprising determining a frequency dependent shaped power limitation characteristic maximizing usage of available output transducer authority, and filtering the input to said output transducer with a filter having a transfer characteristic which is a function of said frequency dependent shaped power limitation characteristic.

22. The method according to claim 21 wherein said transfer characteristic of said filter is a direct function of said frequency dependent shaped power limitation characteristic.

23. The method according to claim 21 comprising summing said first and second correction signals and supplying the resultant sum as a summed correction signal through said filter to said output transducer, to afford first and second pre-summed correction signals prior to said summing, and a post-summed correction signal after said summing and before passage through said filter.

24. The method according to claim 23 comprising comparing said first pre-summed correction signal against said first desired peak value signal at a first comparator to control adaptive leakage of said first weight update signal, and comparing said second pre-summed correction signal against said second desired peak value signal at a second comparator to control adaptive leakage of said second weight update signal.

25. The method according to claim 13 comprising summing said first and second correction signals and supplying the resultant sum as a summed correction signal to said output transducer, to afford a post-summed correction signal after said summing, and first and second pre-summed correction signals prior to said summing, comparing said first pre-summed correction signal against said first desired peak value signal at a first comparator to control adaptive leakage of said first weight update signal, comparing said second pre-summed correction signal against said second desired peak value signal at a second comparator to control adaptive leakage of said second weight update signal.

26. The method according to claim 25 comprising determining a frequency dependent shaped power limitation characteristic maximizing usage of available output transducer authority, and filtering said post-summed correction signal supplied to said output transducer by a filter having a transfer characteristic which is a function of said frequency dependent shaped power limitation characteristic.

27. The method according to claim 26 comprising modeling said output transducer and the error path between said output transducer and said error transducer with a third adaptive filter model having a model input from an auxiliary noise source uncorrelated to said system input signal, and comprising summing the output of said auxiliary noise source with the outputs of said first and second models and filtering the output resultant sum by through said filter before passage to said output transducer.

28. The method according to claim 13 comprising varying each of said first and second desired peak value signals according to frequency.

29. The method according to claim 28 comprising comparing said first Correction signal against said first desired peak value signal at a first comparator to control adaptive leakage of said first weight update signal, comparing said second correction signal against said second desired peak value signal at a second comparator to control adaptive leakage of said second weight update signal, providing a first frequency transfer function varying said first desired peak value signal according to frequency, and providing a second frequency transfer function varying said second desired peak value signal according to frequency.

30. The method according to claim 28 comprising modeling said output transducer and the error path between said output transducer and said error transducer with a third adaptive filter model having a model input from an auxiliary noise source uncorrelated to said system input signal, summing the output of said auxiliary noise source and said first and second correction signals, to afford a post-summed correction signal supplied to said output transducer, a first pre-summed correction signal, and a second pre-summed correction signal, comparing said first pre-summed correction signal against said frequency dependent first desired peak value signal at a first comparator to control adaptive leakage of said first weight update signal, comparing said second pre-summed correction signal against said frequency dependent second desired peak value signal at a second comparator to control adaptive leakage of said second weight update signal.

31. The method according to claim 13 comprising separating said error signal into at least first and second error tones corresponding respectively to said first and second input tones, and combining said first reference signal with said first error tone to provide said first weight update signal, and combining said second reference signal with said second error tone to provide said second weight update signal.

32. The method according to claim 31 comprising providing said first error tone from a first error transducer, and providing said second error tone from a second error transducer.

33. The method according to claim 13 comprising variably balancing leakage of said first and second weight update signals to partition power distribution among said first and second correction signals to limit cumulative power to said output transducer.

34. The method according to claim 33 comprising determining an admissable region of values in a plot of said first correction signal versus said second correction signal, and coordinating control of leakage of said first and second weight update signals to maintain said first and second correction signals in said admissable region.

35. The method according to claim 34 comprising determining the boundary of said admissable region along a boundary line according to the sum of said first and second correction signals being equal to a predetermined maximum value.

36. The method according to claim 34 comprising determining the boundary of said admissable region along a boundary line and determining the optimum point on said boundary line for balancing said first and second desired peak value signals from a starting point off of said boundary line comprising projecting from said starting point to said boundary line along a projection line intersecting and perpendicular to said boundary line, the intersection of said projection line and said boundary line being said optimum point.

37. The method according to claim 34 comprising determining the boundary of said admissable region along a boundary line and maintaining said first and second correction signals on said boundary line.

38. The method according to claim 34 comprising determining the boundary of said admissable region along a boundary line and determining the optimum point on said boundary line for balancing said first and second desired peak value signals from a starting point off of said boundary line comprising projecting from said starting point to said boundary line along a projection line extending from the origin of said plot through said starting point and intersecting said boundary line, the intersection of said projection line and said boundary line being said optimum point.

39. The method according to claim 34 comprising determining the boundary of said admissable region along a boundary line and determining the optimum point on said boundary line for balancing said first and second desired peak value signals from a starting point off of said boundary line comprising determining an error surface around said starting point and projecting from said starting point to said boundary line along a projection line intersecting said boundary line and tangent to said error surface, the intersection of said projection line and said boundary line being said optimum point.

40. An active adaptive control system comprising an output transducer introducing a control signal to combine with a system input signal and yield a system output signal, an error transducer sensing said system output signal and providing an error signal, an adaptive filter model having a model input from a reference signal correlated to said system input signal, and a model output outputting a correction signal to said output transducer to introduce said control signal according to a weight update signal, adaptive leak means adaptively leaking said weight update signal as a function of said correction signal relative to a given peak value according to a desired peak value signal such that said correction signal adaptively converges to a value limited by said peak value, a filter filtering said correction signal by a transfer characteristic which is a function of a frequency dependent shaped power limitation characteristic maximizing usage of available output transducer authority.

41. The system according to claim 40 wherein said filter has a transfer characteristic which is an inverse function of said frequency dependent shaped power limitation characteristic.

42. The system according to claim 41 wherein said filter has a transfer characteristic which is the inverse of said frequency dependent shaped power limitation characteristic.

43. The system according to claim 41 comprising a comparator comparing said correction signal against said desired peak value signal to control adaptive leakage of said weight update signal, and wherein said correction signal from said output of said model is supplied through said filter to said comparator.

44. The system according to claim 43 comprising a second adaptive filter model modeling said output transducer and the error path between said output transducer and said error transducer, said second adaptive filter model having a model input from an auxiliary noise source uncorrelated with said system input signal, a summer summing the output of said auxiliary noise source and said correction signal from said model output of said first mentioned model and supplying the resultant sum to said output transducer, to afford a post-summed correction signal after passage through said summer, and a pre-summed correction signal prior to passage through said summer, a comparator comparing said pre-summed correction signal against said desired peak value signal to control adaptive leakage of said weight update signal, wherein said pre-summed correction signal is supplied through said filter to said comparator.

45. The system according to claim 40 wherein said filter has a transfer characteristic which is a direct function of said frequency dependent shaped power limitation characteristic.

46. The system according to claim 45 wherein said filter has a transfer characteristic which is said frequency dependent shaped power limitation characteristic.

47. The system according to claim 46 wherein said correction signal is supplied from said model output through said filter to said output transducer.

48. The system according to claim 45 wherein said filter filters said correction signal supplied to said output transducer, to afford a post-filtered correction signal after passage through said filter, and a pre-filtered correction signal prior to passage through said filter, a comparator comparing said pre-filtered correction signal against said desired peak value signal to control adaptive leakage of said weight update signal.

49. The system according to claim 48 comprising a second adaptive filter model modeling said output transducer and the error path between said output transducer and said error transducer, said second adaptive filter model having a model input from an auxiliary noise source uncorrelated with said system input signal, a summer summing the output of said auxiliary noise source with said pre-filtered correction signal and supplying the resultant sum to said filter.

50. An active adaptive control system comprising an output transducer introducing a control signal to combine with a system input signal and yield a system output signal, an error transducer sensing said system output signal and providing an error signal, an adaptive filter model having a model input from a reference signal correlated to said system input signal, and a model output outputting a correction signal to said output transducer to introduce said control signal according to a weight update signal, adaptive leak means adaptively leaking said weight update signal as a function of said correction signal relative to a given peak value according to a desired peak value signal such that said correction signal adaptively converges to a value limited by said peak value, frequency transfer means varying said desired peak value signal according to frequency.

51. The system according to claim 50 comprising a comparator comparing said correction signal against said desired peak value signal to control adaptive leakage of said weight update signal, said frequency transfer means controlling said peak value of said desired peak value signal.

52. The system according to claim 50 comprising a second adaptive filter model modeling said output transducer and the error path between said output transducer and said error transducer, said second adaptive filter model having a model input from an auxiliary noise source uncorrelated with said system input signal, a summer summing the output of said auxiliary noise source and said correction signal from said model output of said first mentioned model, to afford a post-summed correction signal after passage through said summer, and a pre-summed correction signal prior to passage through said summer, said post-summed correction signal being supplied to said output transducer, a comparator comparing said pre-summed correction signal against said desired peak value signal to control adaptive leakage of said weight update signal.

53. An active adaptive control system for a system input signal having a plurality of tones, comprising separating means separating said system input signal into at least first and second input tones, an output transducer introducing a control signal to combine with said system input signal and yield a system output signal, an error transducer sensing said system output signal and providing an error signal, a first adaptive filter model having a model input from a first reference signal correlated to said first input tone, and a model output outputting a first correction signal to said output transducer to introduce said control signal according to a first weight update signal, first adaptive leak means adaptively leaking said first update signal as a function of said first correction signal relative to a first given peak value according to a first desired peak value signal such that said first correction signal adaptively converges to a value limited by said first peak value, a second adaptive filter model having a model input from a second reference signal correlated to said second input tone, and a model output outputting a second correction signal to said output transducer to introduce said control signal according to a second weight update signal, second adaptive leak means adaptively leaking said second weight update signal as a function of said second correction signal relative to a second given peak value according to a second desired peak value signal such that said second correction signal adaptively converges to a value limited by said second peak value.

54. The system according to claim 53 comprising filter means filtering said first and second correction signals with a frequency dependent transfer characteristic.

55. The system according to claim 54 wherein said filter means has a transfer characteristic which is a function of a frequency dependent shaped power limitation characteristic maximizing usage of available output transducer authority.

56. The system according to claim 55 wherein said filter means comprises first and second filters each having a transfer characteristic which is an inverse function of said frequency dependent shaped power limitation characteristic.

57. The system according to claim 53 comprising a first filter filtering said first correction signal with a frequency dependent transfer characteristic, to afford a post-filtered first correction signal after passage through said first filter, and a pre-filtered first correction signal prior to passage through said first filter, a second filter filtering said second correction signal with a frequency dependent transfer characteristic, to afford a post-filtered second correction signal after passage through said second filter, and a pre-filtered second correction signal prior to passage through said second filter, a first comparator comparing said first post-filtered correction signal against said first desired peak value signal to control adaptive leakage of said first weight update signal, a second comparator comparing said second post-filtered correction signal against said desired peak value signal to control adaptive leakage of said second weight update signal.

58. The system according to claim 57 comprising a summer summing said first and second pre-filtered correction signals and supplying the resultant sum to said output transducer.

59. The system according to claim 58 comprising a third adaptive filter model modeling said output transducer and the error path between said output transducer and said error transducer, said third adaptive filter model having a model input from an auxiliary noise source uncorrelated with said system input signal, wherein said summer sums the output of said auxiliary noise source with said first and second pre-filtered correction signals and supplies the resultant sum to said output transducer.

60. The system according to claim 53 comprising a filter filtering the input to said output transducer with a frequency dependent transfer characteristic.

61. The system according to claim 60 wherein said filter has a transfer characteristic which is a function of a frequency dependent shaped power limitation characteristic maximizing usage of available output transducer authority.

62. The system according to claim 61 wherein said filter has a transfer characteristic which is a direct function of said frequency dependent shaped power limitation characteristic.

63. The system according to claim 62 wherein said filter has a transfer characteristic which is said frequency dependent shaped power limitation characteristic.

64. The system according to claim 60 comprising a summer summing said first and second correction signals and supplying the resultant sum as a summed correction signal to said output transducer, and wherein said filter filters said summed correction signal.

65. The system according to claim 53 comprising a summer summing said first and second correction signals and supplying the resultant sum as a summed correction signal to said output transducer, to afford a post-summed correction signal after passage through said summer, and first and second pre-summed correction signals prior to passage through said summer, a first comparator comparing said first pre-summed correction signal against said first desired peak value signal to control adaptive leakage of said first weight update signal, a second comparator comparing said second pre-summed correction signal against said second desired peak value signal to control adaptive leakage of said second weight update signal.

66. The system according to claim 65 comprising a filter filtering said post-summed correction signal supplied to said output transducer by a transfer characteristic which is a function of a frequency dependent shaped power limitation characteristic maximizing usage of available output transducer authority.

67. The system according to claim 66 comprising a third adaptive filter model modeling said output transducer and the error path between said output transducer and said error transducer, said third adaptive filter model having a model input from an auxiliary noise source uncorrelated with said system input signal, a summer summing the output of said auxiliary noise source with the outputs of said first and second models, and wherein said filter filters the output resultant sum from said summer by a transfer characteristic which is a direct function of said frequency dependent shaped power limitation characteristic before passage to said output transducer.

68. The system according to claim 53 comprising frequency transfer means varying said first and second desired peak value signals according to frequency.

69. The system according to claim 68 comprising a first comparator comparing said first correction signal against said first desired peak value signal to control adaptive leakage of said first weight update signal, a second comparator comparing said second correction signal against said second desired peak value signal to control adaptive leakage of said second weight update signal, a first frequency transfer function varying said first desired peak value signal according to frequency, and a second frequency transfer function varying said second desired peak value signal according to frequency.

70. The system according to claim 68 comprising a third adaptive filter model modeling said output transducer and the error path between said output transducer and said error transducer, said third adaptive filter model having a model input from an auxiliary noise source uncorrelated to said system input signal, a summer summing the output of said auxiliary noise source and said first and second correction signals, to afford a post-summed correction signal supplied to said output transducer, a first pre-summed correction signal, and a second pre-summed correction signal, a first comparator comparing said first pre-summed correction signal against said frequency dependent first desired peak value signal to control adaptive leakage of said first weight update signal, a second comparator comparing said second pre-summed correction signal against said frequency dependent second desired peak value signal to control adaptive leakage of said second weight update signal.

71. The system according to claim 53 comprising separating means separating said error signal into at least first and second error tones corresponding respectively to said first and second input tones, a first combiner combining said first reference signal with said first error tone to provide said first weight update signal, and a second combiner combining said second reference signal with said second error tone to provide said second weight update signal.

72. The system according to claim 71 comprising a first error transducer providing said first error tone, and a second error transducer providing said second error tone.

* * * * *